US012448240B2

(12) United States Patent
Uesugi et al.

(10) Patent No.: US 12,448,240 B2
(45) Date of Patent: Oct. 21, 2025

(54) IMAGE FORMING APPARATUS

(71) Applicant: CANON KABUSHIKI KAISHA, Tokyo (JP)

(72) Inventors: Takuji Uesugi, Kanagawa (JP); Akira Yoshimura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 78 days.

(21) Appl. No.: 18/424,529

(22) Filed: Jan. 26, 2024

(65) Prior Publication Data

US 2024/0253921 A1 Aug. 1, 2024

(30) Foreign Application Priority Data

Jan. 31, 2023 (JP) ..... 2023-012436
Jan. 31, 2023 (JP) ..... 2023-012438

(51) Int. Cl.
*G03G 21/16* (2006.01)
*B65H 5/36* (2006.01)
*G03G 21/00* (2006.01)

(52) U.S. Cl.
CPC ..... *B65H 5/36* (2013.01); *B65H 2301/4382* (2013.01); *B65H 2301/5121* (2013.01); *B65H 2557/30* (2013.01); *B65H 2701/122* (2013.01); *B65H 2701/173* (2013.01); *B65H 2801/03* (2013.01)

(58) Field of Classification Search
CPC ..... B65H 2402/60; G03G 16/47; G03G 16/1652; G03G 16/1619; G03G 16/1695; G03G 16/1642; G03G 2221/1651; G03G 2221/1654
See application file for complete search history.

(56) References Cited

U.S. PATENT DOCUMENTS

2017/0031303 A1* 2/2017 Tamura ..... F16H 1/20

FOREIGN PATENT DOCUMENTS

| | | |
|---|---|---|
| JP | 2013227147 A | 11/2013 |
| JP | 2013244521 A | 12/2013 |
| JP | 2017136759 A | 8/2017 |

* cited by examiner

*Primary Examiner* — Luis A Gonzalez
(74) *Attorney, Agent, or Firm* — Canon U.S.A., Inc. IP Division

(57) ABSTRACT

An image forming apparatus for forming an image on a recording material includes first and second sheet metal and a moving member. The first sheet metal includes a first facing surface and a first rear surface. The second sheet metal is fixed to the first sheet metal at a fixing portion and includes a second facing surface facing the first facing surface and a second rear surface. The first sheet metal is deformed in a first direction from the first rear surface toward the first facing surface in such a manner that the fixing portion is formed. The fixing portion includes a projection projecting from the second rear surface in the first direction. The moving member overlaps the fixing portion and is disposed at a position that is on an opposite side of the first rear surface from the projection and faces the first rear surface in the first direction.

23 Claims, 15 Drawing Sheets

IMAGE FORMING APPARATUS

BACKGROUND

Field

The present disclosure relates to an image forming apparatus that forms an image on a recording material.

Description of the Related Art

Image forming apparatuses, such as a printer, a copying machine, and a multifunction peripheral, include a frame formed in combination with a plurality of sheets of metal. A driving unit including a motor and a gear and a substrate equipped with electrical elements can be attached to the frame.

Japanese Patent Application Laid-Open No. 2017-136759 discusses an image forming apparatus that includes a driving unit including a motor and a gear, a substrate equipped with electrical elements, and a frame including a right side plate, a left side plate, and stays fastened to the right and left side plates. The driving unit and the substrate are attached to the frame.

SUMMARY

The present disclosure is directed to further development of a conventional technique.

According to an aspect of the present disclosure, an image forming apparatus for forming an image on a recording material, the image forming apparatus includes a first sheet metal including a first facing surface and a first rear surface opposite to the first facing surface, a second sheet metal that is fixed to the first sheet metal at a fixing portion and including a second facing surface facing the first facing surface and a second rear surface opposite to the second facing surface, and a moving member configured to be movable with respect to the first sheet metal, wherein the moving member is disposed so that the moving member at least partly overlaps the fixing portion when seen in an orthogonal direction that is orthogonal to the first facing surface, wherein the first sheet metal is deformed in a first direction from the first rear surface toward the first facing surface in such a manner that the fixing portion is formed, and the fixing portion includes a projection projecting from the second rear surface in the first direction, and wherein the moving member is disposed at a position that is on an opposite side of the first rear surface from the projection and faces the first rear surface in the first direction.

Further features of the present disclosure will become apparent from the following description of exemplary embodiments with reference to the attached drawings.

DESCRIPTION OF THE EMBODIMENTS

Hereinafter, exemplary embodiments for carrying out the present disclosure will be described in detail by way of examples with reference to the drawings. The dimensions, materials, shapes, relative arrangements, and the like of components described in the exemplary embodiments should be appropriately changed depending on a configuration of an apparatus to which the present disclosure is applied and various conditions.

<Image Forming Apparatus>

Figure 1:
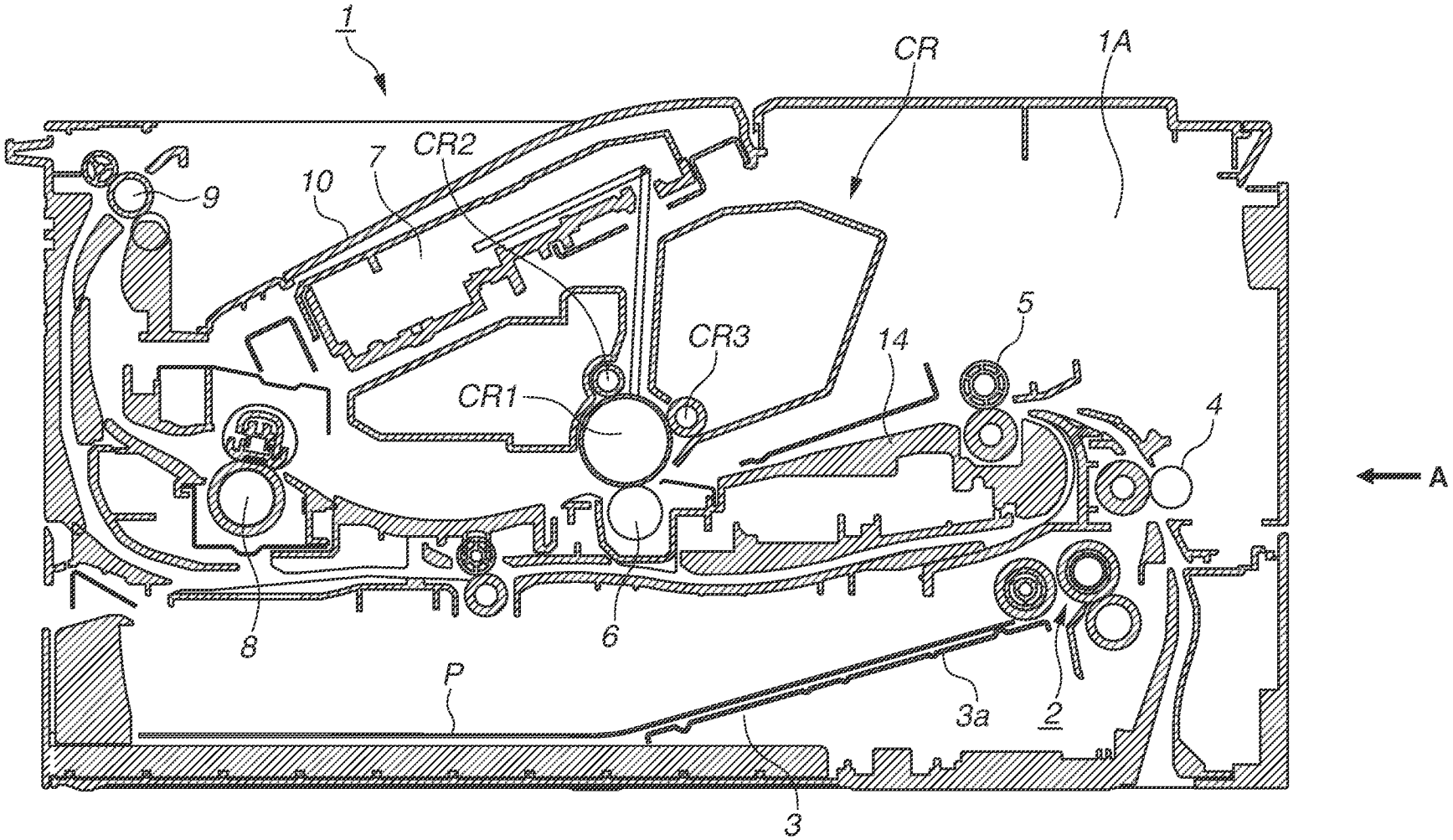
FIG. 1 is a sectional view of an image forming apparatus.

An image forming apparatus 1 according to a first exemplary embodiment will be described with reference to FIG. 1. FIG. 1 is a sectional view of the image forming apparatus 1.

The image forming apparatus 1 according to the present exemplary embodiment is configured to form an image on a sheet P serving as a recording material. The image forming apparatus 1 includes an apparatus main body 1A and a cartridge CR detachably attachable to the apparatus main body 1A. The apparatus main body 1A can be said to be the rest of the image forming apparatus 1 from which the cartridge CR is excluded.

The apparatus main body 1A of the image forming apparatus 1 includes a sheet accommodation unit 3 including a sheet lifting portion 3*a*, a feed unit 2, a conveyance roller pair 4, a conveyance roller pair 5, a transfer unit (transfer roller) 6, an optical scanner 7 serving as an exposure device, a fixing unit 8, a discharge unit 9, and a discharge tray 10.

The cartridge CR includes a photosensitive drum (photosensitive member) CR1, a charging member CR2 that charges the photosensitive drum CR1, and a developing roller CR3 that faces the photosensitive drum CR1 and develops an electrostatic latent image formed on the photosensitive drum CR1.

The sheet P is set on the sheet lifting portion 3*a*. In an image forming operation on the sheet P, the sheet P is lifted up by the sheet lifting portion 3*a* and conveyed from the feed unit 2 to the transfer unit 6 via the conveyance roller pairs 4 and 5.

The apparatus main body 1A of the image forming apparatus 1 includes a main frame 14. The main frame 14 forms at least a part of a conveyance path through which the sheet P is conveyed. A part of the main frame 14 faces the conveyance path of the sheet P and functions as a guide portion for guiding the sheet P. In other words, the main frame 14 includes the guide portion for guiding the sheet P.

The photosensitive drum CR1 is charged by the charging member CR2. The optical scanner 7 is configured to expose the photosensitive drum CR1. A surface of the photosensitive drum CR1 is exposed by the optical scanner 7, based on image information. As a result of the exposure, an electrostatic latent image is formed on the surface of the photosensitive drum CR1. Toner serving as a developer is supplied from the developing roller CR3 to the photosensitive drum CR1, whereby the electrostatic latent image formed on the photosensitive drum CR1 is developed. This forms a toner image on the photosensitive drum CR1.

The transfer unit 6 faces the photosensitive drum CR1. A predetermined voltage is applied to the transfer unit 6 from a not-illustrated power supply, and the toner image formed on the photosensitive drum CR1 is transferred to the sheet P by the transfer unit 6.

The fixing unit 8 includes a heating unit (heater). The fixing unit 8 heats the sheet P onto which the toner image has been transferred, whereby the toner image is fixed to the sheet P. The sheet P is then discharged to the discharge tray 10 by the discharge unit 9.

In the present exemplary embodiment, the image forming apparatus 1 can convey the sheet P passed through the fixing unit 8 toward the transfer unit 6 via a two-sided conveyance path to form images on both sides of the sheet P.

As described above, in the present exemplary embodiment, the image forming apparatus 1 is a laser beam printer that forms a monochrome image on a sheet P serving as a recording material, using an electrophotographic process.

However, the image forming apparatus 1 may be a printer other than a laser beam printer, such as an inkjet printer and a light-emitting diode (LED) printer using an LED as the exposure device. The image forming apparatus 1 may be an image forming apparatus that forms a color image on a sheet P.

<Main Body Frame>

A main body frame 11 of the image forming apparatus 1 will be described with reference to FIGS. 1, 2A, 2B, 3A, and 3B.

Figure 2B:
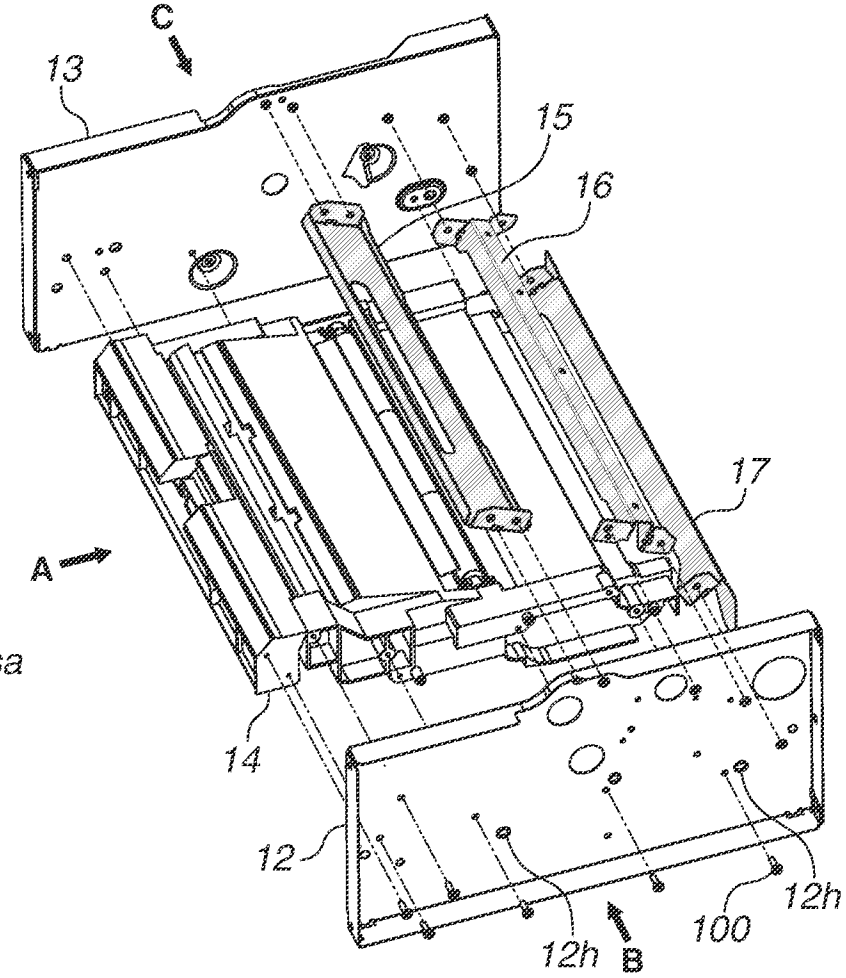
FIG. 2B is an exploded perspective view illustrating the main body frame of the image forming apparatus.
Figure 2A:
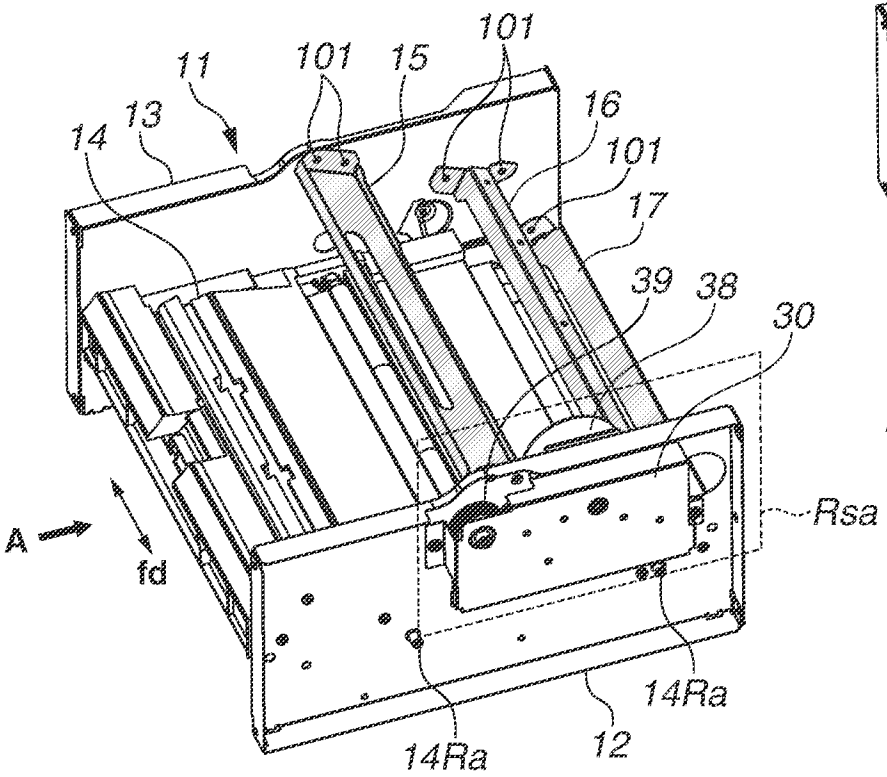
FIG. 2A is a perspective view illustrating a main body frame of the image forming apparatus.
Figure 3B:
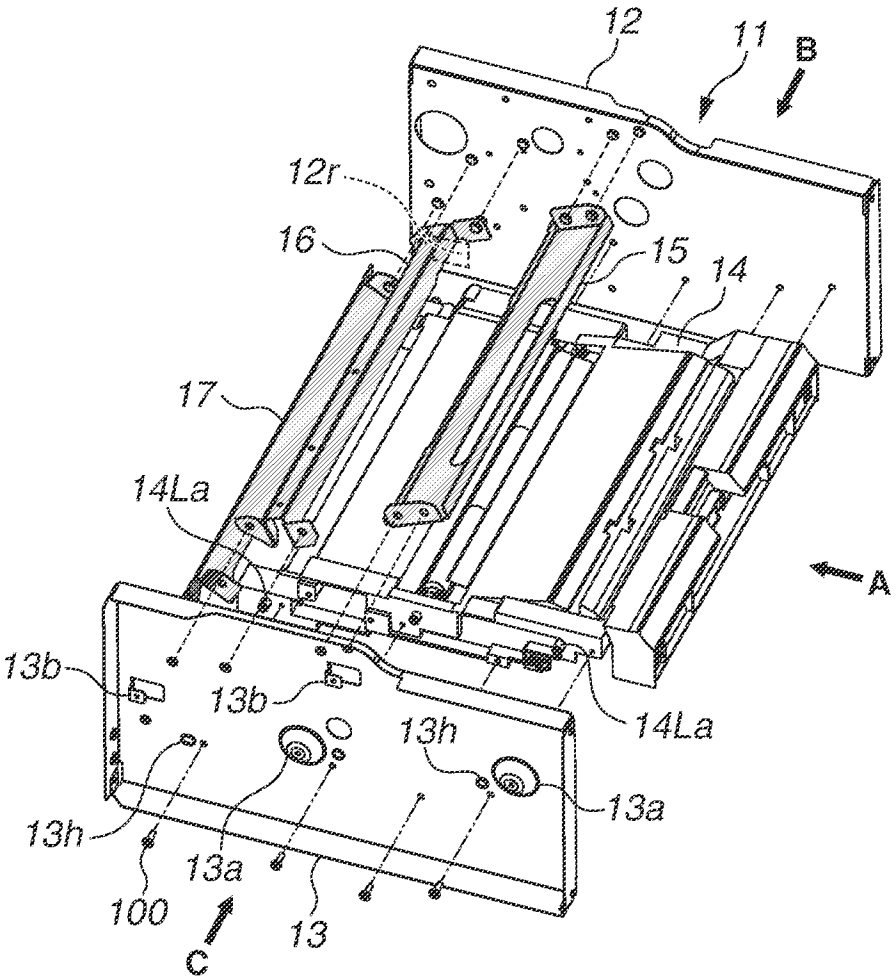
FIG. 3B is an exploded perspective view illustrating the main body frame of the image forming apparatus.
Figure 3A:
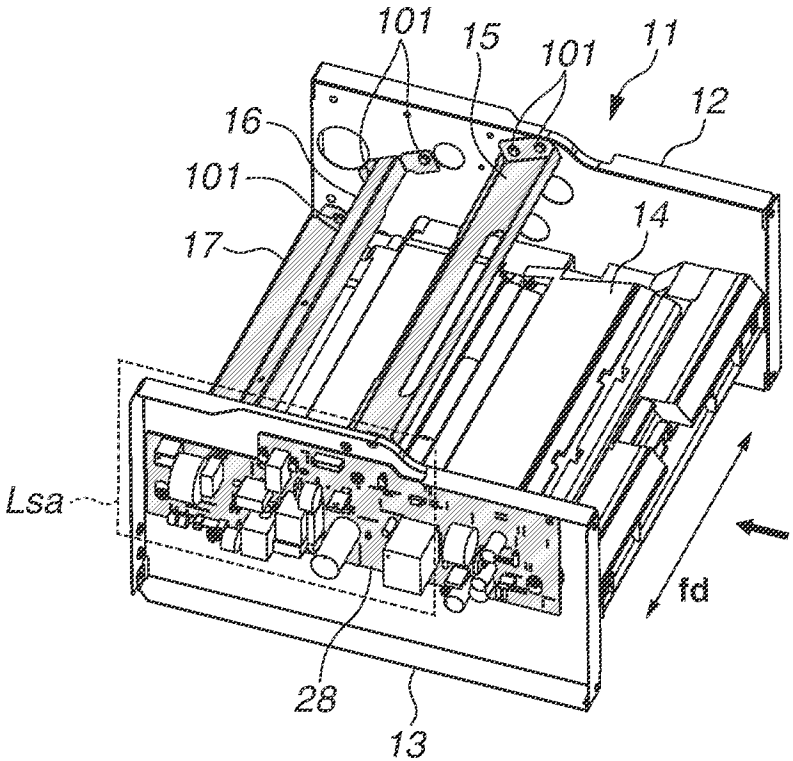
FIG. 3A is a perspective view illustrating the main body frame of the image forming apparatus.

FIGS. 2A and 3A are perspective views illustrating the main body frame 11 of the image forming apparatus 1. FIGS. 2B and 3B are exploded perspective views illustrating the main body frame 11 of the image forming apparatus 1. In FIGS. 2A, 2B, 3A, and 3B, some parts, such as the feed unit 2, the conveyance roller pairs 4 and 5, the optical scanner 7, and exteriors including the discharge tray 10, are omitted.

In the following description, top-to-bottom, left-to-right, and front-to-rear directions are defined with respect to the view in the direction of the arrow A in FIG. 2A. The top-to-bottom direction is parallel to the vertical direction. The arrow A is parallel to the front-to-rear direction. The front-to-rear direction and the left-to-right direction are parallel to horizontal directions. The top-to-bottom direction, the left-to-right direction, and the front-to-rear direction are orthogonal to each other.

As illustrated in FIGS. 2A, 2B, 3A, and 3B, the main body frame 11 includes a left side plate 13 and a right side plate 12. The left side plate 13 and the right side plate 12 face to each other in a facing direction fd. The conveyance path through which the sheet P is conveyed is disposed between the right side plate 12 and the left side plate 13 in the facing direction fd. In the present exemplary embodiment, the facing direction fd agrees with a width direction orthogonal to a conveyance direction of the sheet P. In the present exemplary embodiment, the left side plate 13 and the right side plate 12 are made of sheets of metal.

A motor 38 serving as a driving source, a drive train 39 including a plurality of gears, and a gear cover 30 covering the drive train 39 are attached to the right side plate 12. In FIG. 2B, the motor 38, the drive train 39, and the gear cover 30 are omitted.

An electronic substrate 28 is attached to the left side plate 13. The left side plate 13 includes drawn shapes 13*a* and bent portions 13*b*. The drawn shapes 13*a* and the bent portions 13*b* function as a receiving portion for receiving the electronic substrate 28. The left side plate 13 supports the electronic substrate 28 by the drawn shapes 13*a* and the bent portions 13*b*. In FIG. 3B, the electronic substrate 28 is omitted.

The main body frame 11 includes the main frame 14, a front scanner frame (front scanner stay) 15, a rear scanner frame (rear scanner stay) 16, and a rear frame (rear stay) 17. The main frame 14, the front scanner frame 15, the rear scanner frame 16, and the rear frame 17 are disposed between the left side plate 13 and the right side plate 12 in the facing direction fd. The front scanner frame 15 and the rear scanner frame 16 support the optical scanner 7. The facing direction fd is parallel to the left-to-right direction.

The front scanner frame 15, the rear scanner frame 16, and the rear frame 17 are disposed in parallel with each other to bridge the space between the right side plate 12 and the left side plate 13, and connected to the right side plate 12 and the left side plate 13.

The main frame 14 is made of a resin. In the present exemplary embodiment, the main frame 14 supports the transfer unit 6 that is a rotating body. The main frame 14 is made of an insulating resin to prevent leakage of a voltage applied to the transfer unit 6. The main frame 14 supports one roller of the conveyance roller pair 4, one roller of the conveyance roller pair 5, and a part of the feed unit 2. The facing direction fd agrees with a direction of a rotation axis of the transfer unit 6.

The main frame 14 includes projections 14Ra. The projections 14Ra are inserted into holes 12*h* in the right side plate 12, whereby the main frame 14 is supported by the right side plate 12. In the present exemplary embodiment, the main frame 14 includes a plurality of projections 14Ra, and the right side plate 12 has a plurality of holes 12*h*. The plurality of holes 12*h* each are a round hole or a long hole. With the projections 14Ra inserted in the holes 12*h*, positions of the projections 14Ra and positions of the holes 12*h* coincide with each other in the facing direction fd. As a result, the main frame 14 is restricted from moving with respect to the right side plate 12 in directions orthogonal to the facing direction fd. In the present exemplary embodiment, the state where the projections 14Ra are inserted in the holes 12*h* can be referred to as a state in which the projections 14Ra penetrate through the right side plate 12 via the holes 12*h*.

The main frame 14 may have holes corresponding to the holes 12*h*, and the right side plate 12 may have projections to be inserted into the holes. In other words, either one of the main frame 14 and the right side plate 12 has projections, and the other of the main frame 14 and the right side plate 12 has holes for the projections to be inserted into.

The main frame 14 is further fixed to the right side plate 12 with a plurality of screws 100 serving as fastening members.

The main frame 14 includes projections 14La. The projections 14La are inserted into holes 13*h* in the left side plate 13, whereby the main frame 14 is supported by the left side plate 13. In the present exemplary embodiment, the main frame 14 includes a plurality of projections 14La, and the left side plate 13 has a plurality of holes 13*h*. The plurality of holes 13*h* each are a round hole or a long hole. With the projections 14La inserted in the holes 13*h*, positions of the projections 14La and positions of the holes 13*h* coincide with each other in the facing direction fd. As a result, the main frame 14 is restricted from moving with respect to the left side plate 13 in directions orthogonal to the facing direction fd. In the present exemplary embodiment, the state where the projections 14La are inserted in the holes 13*h* can be referred to as a state in which the projections 14La penetrate through the left side plate 13 via the holes 13*h*.

The main frame 14 may have holes corresponding to the holes 13*h*, and the left side plate 13 may have projections to be inserted into the holes. In other words, either one of the main frame 14 and the left side plate 13 has projections, and the other of the main frame 14 and the left side plate 13 has holes for the projections to be inserted into.

The main frame 14 is further fixed to the left side plate 13 with a plurality of screws 100 serving as fastening members.

In the present exemplary embodiment, the front scanner frame 15, the rear scanner frame 16, the rear frame 17, the left side plate 13, and the right side plate 12 are formed of plates of metal (sheets of metal). The front scanner frame 15, the rear scanner frame 16, and the rear frame 17 are fixed to the left side plate 13 and the right side plate 12 via fixing portions 101. As a result, the front scanner frame 15, the rear scanner frame 16, and the rear frame 17 are restricted from moving with respect to the left side plate 13 and the right side plate 12 in the facing direction fd, an orthogonal direction orthogonal to the facing direction fd, and a direction orthogonal to the facing direction fd and the orthogonal direction.

When either one of the left side plate 13 and the right side plate 12 is referred to as a first sheet metal, and the other is referred to as a third sheet metal, the front scanner frame 15, the rear scanner frame 16, and the rear frame 17 can be referred to as second sheets of metal connected to the first and third sheets of metal. The first and third sheets of metal face each other, and the conveyance path through which the sheet P is conveyed is disposed between the first and third sheets of metal.

<Fixing Portions>

Figure 4C:
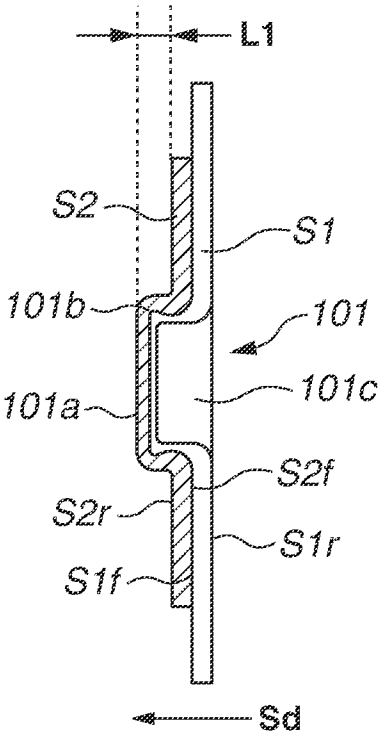
FIG. 4C is a sectional view of the fixing portion according to the first exemplary embodiment.
Figure 4B:
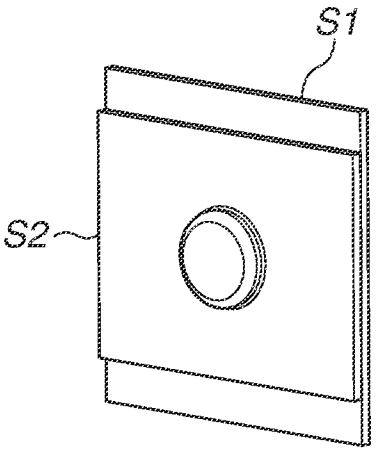
FIGS. 4A and 4B are perspective views of a fixing portion according to a first exemplary embodiment.
Figure 4A:
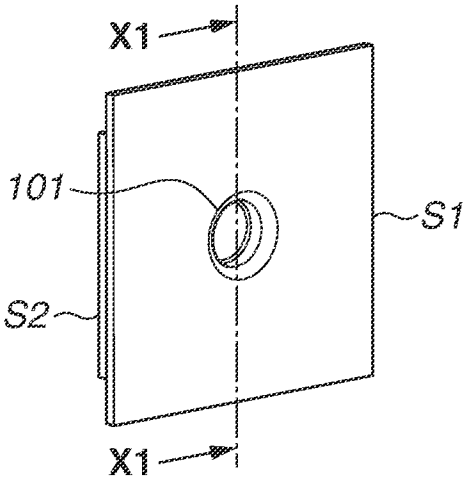

The fixing portions 101 for fixing the front scanner frame 15, the rear scanner frame 16, and the rear frame 17 to the left side plate 13 and the right side plate 12 have a common configuration. The fixing portions 101 will be described with reference to FIGS. 4A to 4C. FIGS. 4A to 4C are diagrams for illustrating the fixing portions 101. FIGS. 4A and 4B are perspective views of the fixing portion 101. FIG. 4C is a sectional view of the fixing portion 101. Specifically, FIG. 4C is a sectional view taken along the line X1-X1 of FIG. 4A.

A first sheet metal S1 and a second sheet metal S2 are fixed to each other by the fixing portion 101.

Either the front scanner frame 15, the rear scanner frame 16, and the rear frame 17 or the left side plate 13 and the right side plate 12 correspond to the first sheet metal S1. The others correspond to the second sheet metal S2.

In the present exemplary embodiment, the fixing portion 101 is formed by deforming the first sheet metal S1 and the second sheet metal S2. The fixing portion 101 according to the present exemplary embodiment can be referred to as a mechanical fastening portion (a formed connection portion), without using a rivet, which utilizes plastic deformation of the first sheet metal S1 and the second sheet metal S2.

The first sheet metal S1 has a first facing surface S1*f* and a first rear surface S1*r* that is a surface opposite to the first facing surface S1*f*. The second sheet metal S2 has a second facing surface S2*f* facing the first facing surface S1*f* and a second rear surface S2*r* that is a surface opposite to the second facing surface S2*f*.

The first facing surface S1*f* and the first rear surface S1*r* are surfaces orthogonal to a thickness direction of the first sheet metal S1. The second facing surface S2*f* and the second rear surface S2*r* are surfaces orthogonal to a thickness direction of the second sheet metal S2.

The first sheet metal S1 and the second sheet metal S2 are deformed in a deformation direction (first direction) Sd.

The deformation direction Sd is from the first rear surface S1*r* toward the first facing surface S1*f* of the first sheet metal S1. It is desirable that the deformation direction Sd should be parallel to the thickness direction of the first sheet metal S1. It is desirable that the deformation direction Sd should be in (desirably parallel to) the facing direction fd.

The fixing portion 101 includes a projection 101*a* projecting from the second rear surface S2*r* of the second sheet metal S2 in the deformation direction Sd. The height of the projection 101*a* from the second rear surface S2*r* may be referred to as a projection length L1. In the present exemplary embodiment, the projection 101*a* is formed by deforming the second sheet metal S2. The first sheet metal S1 is also deformed to form a recess 101*c* in the first rear surface S1*r* toward the first facing surface S1*f*. In other words, the fixing portion 101 according to the present exemplary embodiment has the recess 101*c*. The fixing portion 101 according to the present exemplary embodiment is formed such that there is no projection from the first rear surface S1*r*.

The fixing portion 101 is formed by using the following method. The first sheet metal S1 and the second sheet metal S2 are stacked by bringing the first facing surface S1*f* and the second facing surface S2*f* in contact with each other. A recessed base having a recess is placed on the second rear surface S2*r* of the second sheet metal S2. A columnar pressing member is placed on the first rear surface S1*r* of the first sheet metal S1.

The first rear surface S1*r* is pressed toward the recess of the base by the pressing member, whereby the first sheet metal S1 and the second sheet metal S2 are deformed by being pressed into the recess, and the projection 101*a* and the recess 101*c* are formed. The recess and the pressing member may be shaped such that a part of the first sheet metal S1 protrudes radially outward of the pressing member to form a locking portion 101*b*. The formation of the locking portion 101*b* can further reliably prevent separation of the first sheet metal S1 and the second sheet metal S2.

In the present exemplary embodiment, the left side plate 13 and the right side plate 12 correspond to the first sheet metal S1, and the front scanner frame 15, the rear scanner frame 16, and the rear frame 17 correspond to the second sheet metal S2, which means that the projections 101*a* project toward the space between the left side plate 13 and the right side plate 12. In other words, the projections 101*a* project toward the inside of the apparatus main body 1A (space between the left side plate 13 and the right side plate 12) in the facing direction fd. This can reduce the distance between the projections 101*a* of the fixing portions 101 formed on the left side plate 13 and the projections 101*a* of the fixing portions 101 formed on the right side plate 12 in the facing direction fd.

Since the front scanner frame 15, the rear scanner frame 16, and the rear frame 17 are fixed to the left side plate 13 and the right side plate 12 by the fixing portions 101, fastening parts such as screws do not need to be used. This can increase the rigidity of the main body frame 11.

If the front scanner frame 15, the rear scanner frame 16, and the rear frame 17 are separated from the left side plate 13 and the right side plate 12, at least either the front scanner frame 15, the rear scanner frame 16, and the rear frame 17 or the left side plate 13 and the right side plate 12 are plastically deformed.

An assembly method (production method) of the image forming apparatus 1 according to the present exemplary embodiment will be described. The assembly method of the image forming apparatus 1 includes assembling the main body frame 11 (production method of the main body frame 11).

The assembling the main body frame 11 will be described. As illustrated in FIGS. 2B and 3B, the right side plate 12 is attached to the main frame 14, the front scanner frame 15, the rear scanner frame 16, and the rear frame 17 in the direction of the arrow B, and the left side plate 13 is attached in the direction of the arrow C. In the assembling, the projections 14Ra of the main frame 14 are inserted into the holes 12*h*, and the projections 14La are inserted into the holes 13*h*.

The fixing portions 101 are formed with the main frame 14, the front scanner frame 15, the rear scanner frame 16, and the rear frame 17 interposed between the left side plate 13 and the right side plate 12. As a result, the front scanner frame 15, the rear scanner frame 16, and the rear frame 17 are fixed to the left side plate 13 and the right side plate 12. The main frame 14 is then fixed to the left side plate 13 and the right side plate 12 with screws 100. In this manner, the main body frame 11 is assembled.

After the assembly of the main body frame 11, the motor 38, the drive train 39, and the gear cover 30 are attached to the right side plate 12. The electronic substrate 28 is attached to the left side plate 13. In other words, the assembly method of the image forming apparatus 1 includes the assembling of the main body frame 11, the attaching of the motor 38, the drive train 39, and the gear cover 30 to the right side plate 12, and the attaching of the electronic substrate 28 to the left side plate 13.

After the fixing of the front scanner frame 15, the rear scanner frame 16, and the rear frame 17 to the left side plate 13 and the right side plate 12, an increase in the distance between the left side plate 13 and the right side plate 12 is restricted. Thus, the projections 14Ra and the projections 14La are inserted into the holes 12*h* and the holes 13*h*, respectively, before the front scanner frame 15, the rear scanner frame 16, and the rear frame 17 are fixed to the left side plate 13 and the right side plate 12.

More specifically, the left side plate 13 and the right side plate 12 are attached to the main frame 14 before the formation of the fixing portions 101. In other words, the fixing portions 101 are formed after the left side plate 13 and the right side plate 12 are attached to the main frame 14.

If the front scanner frame 15, the rear scanner frame 16, and the rear frame 17 are fixed to the left side plate 13 and the right side plate 12 by welding, heat and sparks can occur due to the welding. If the front scanner frame 15, the rear scanner frame 16, and the rear frame 17 are fixed by welding with the left side plate 13 and the right side plate 12 attached to the main frame 14, materials usable for the main frame 14 are limited.

In the present exemplary embodiment, a solenoid 12*r* (see FIG. 3B) is attached to the right side plate 12 before the front scanner frame 15, the rear scanner frame 16, and the rear frame 17 are fixed to the left side plate 13 and the right side plate 12. The front scanner frame 15, the rear scanner frame 16, and the rear frame 17 are fixed to the left side plate 13 and the right side plate 12 with the electronic substrate (not illustrated) disposed on the main frame 14 facing the left side plate 13.

Using electric welding restricts attaching of electrically driven parts to or the vicinity of the left side plate 13, the right side plate 12, the front scanner frame 15, the rear scanner frame 16, and the rear frame 17 to a timing before electrical welding. Examples of the electrically driven parts include actuators, such as a solenoid and a motor, various electrical parts, and electronic substrates.

Because of the above-described reason, the front scanner frame 15, the rear scanner frame 16, and the rear frame 17 are fixed to the left side plate 13 and the right side plate 12 with the fixing portions 101. Unlike electrical welding, the formation of the fixing portions 101 according to the present exemplary embodiment does not produce an electrical discharge. Electrically driven parts can thus be attached to or the vicinity of the left side plate 13, the right side plate 12, the front scanner frame 15, the rear scanner frame 16, and the rear frame 17 before the formation of the fixing portions 101.

As described above, restrictions on the assembly order of the image forming apparatus 1 can be reduced by fixing the front scanner frame 15, the rear scanner frame 16, and the rear frame 17 to the left side plate 13 and the right side plate 12 with the fixing portions 101. For example, after the left side plate 13 and the right side plate 12 are attached to the main frame 14, the front scanner frame 15, the rear scanner frame 16, and the rear frame 17 can be fixed to the left side plate 13 and the right side plate 12. Further, electrically driven parts can be attached to or the vicinity of the left side plate 13, the right side plate 12, the front scanner frame 15, the rear scanner frame 16, and the rear frame 17 before the formation of the fixing portions 101. Moreover, the degrees of freedom in selecting the material of the main frame 14 (materials of parts used in the image forming apparatus 1) can be improved.

<Arrangement of Drive Train and Fixing Portions>

Next, the arrangement of the drive train 39 and the fixing portions 101 will be described with reference to FIGS. 5A, 5B, and 6.

Figure 5A:
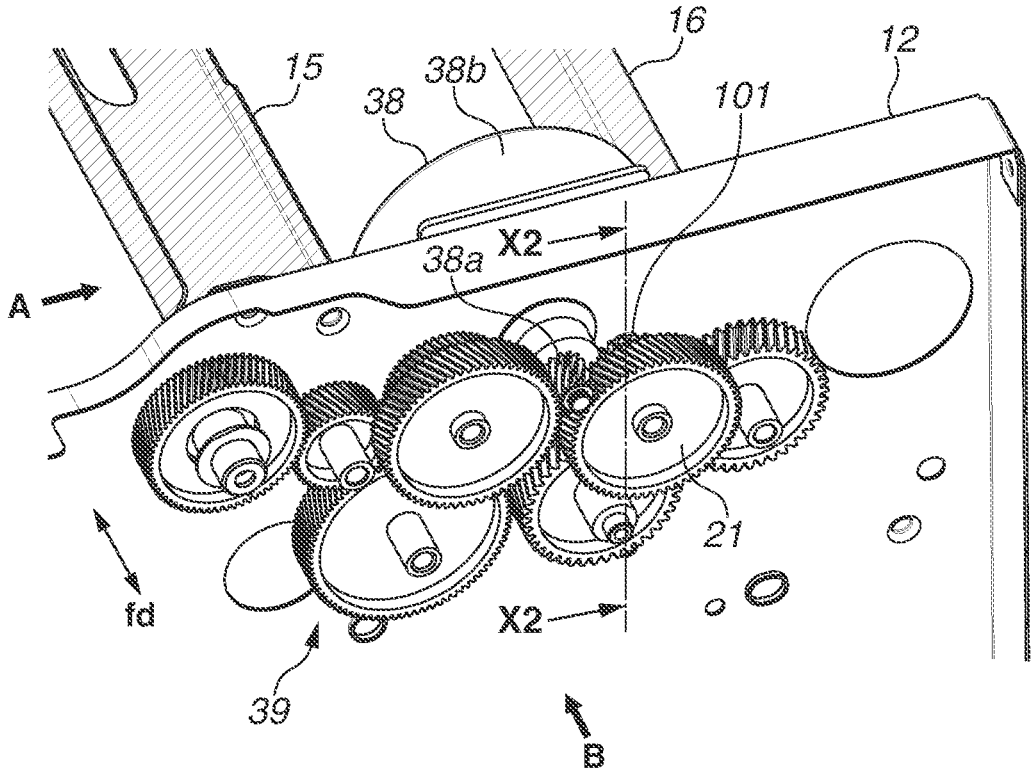
FIGS. 5A and 5B are diagrams illustrating a drive train.
Figure 5B:
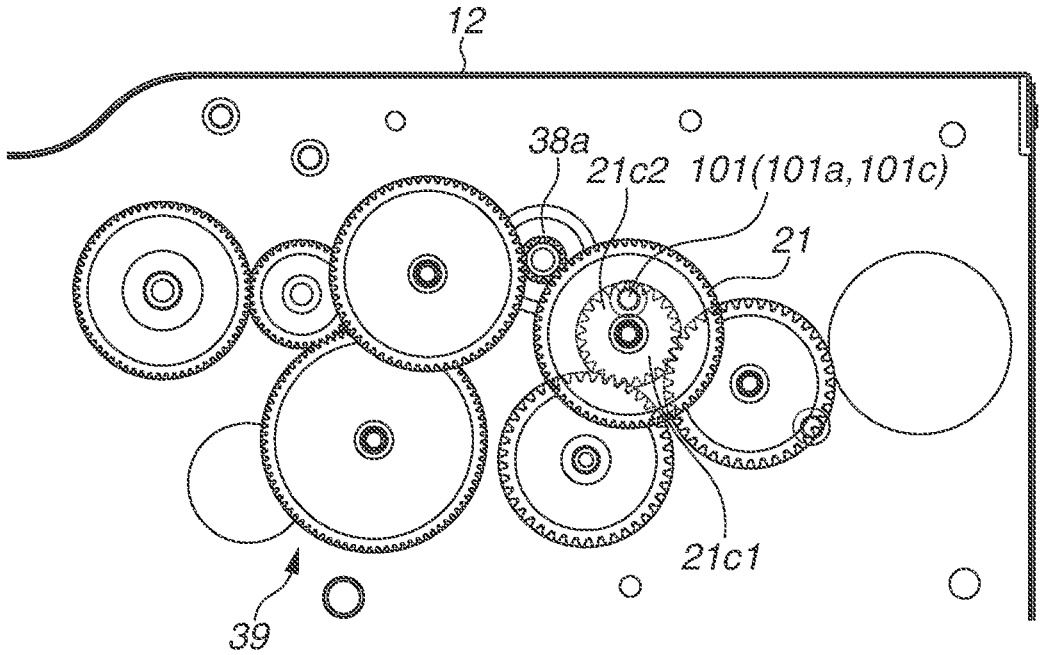

FIGS. 5A and 5B are diagrams illustrating the drive train 39. More specifically, FIG. 5A is a perspective view of and around a range Rsa illustrated in FIG. 2A. FIG. 5B is a side view of and around the range Rsa illustrated in FIG. 2A.

FIG. 5B is a side view in the range Rsa seen in the facing direction fd (direction of the arrow B). In FIGS. 5A and 5B, the gear cover 30 is omitted.

Figure 6:
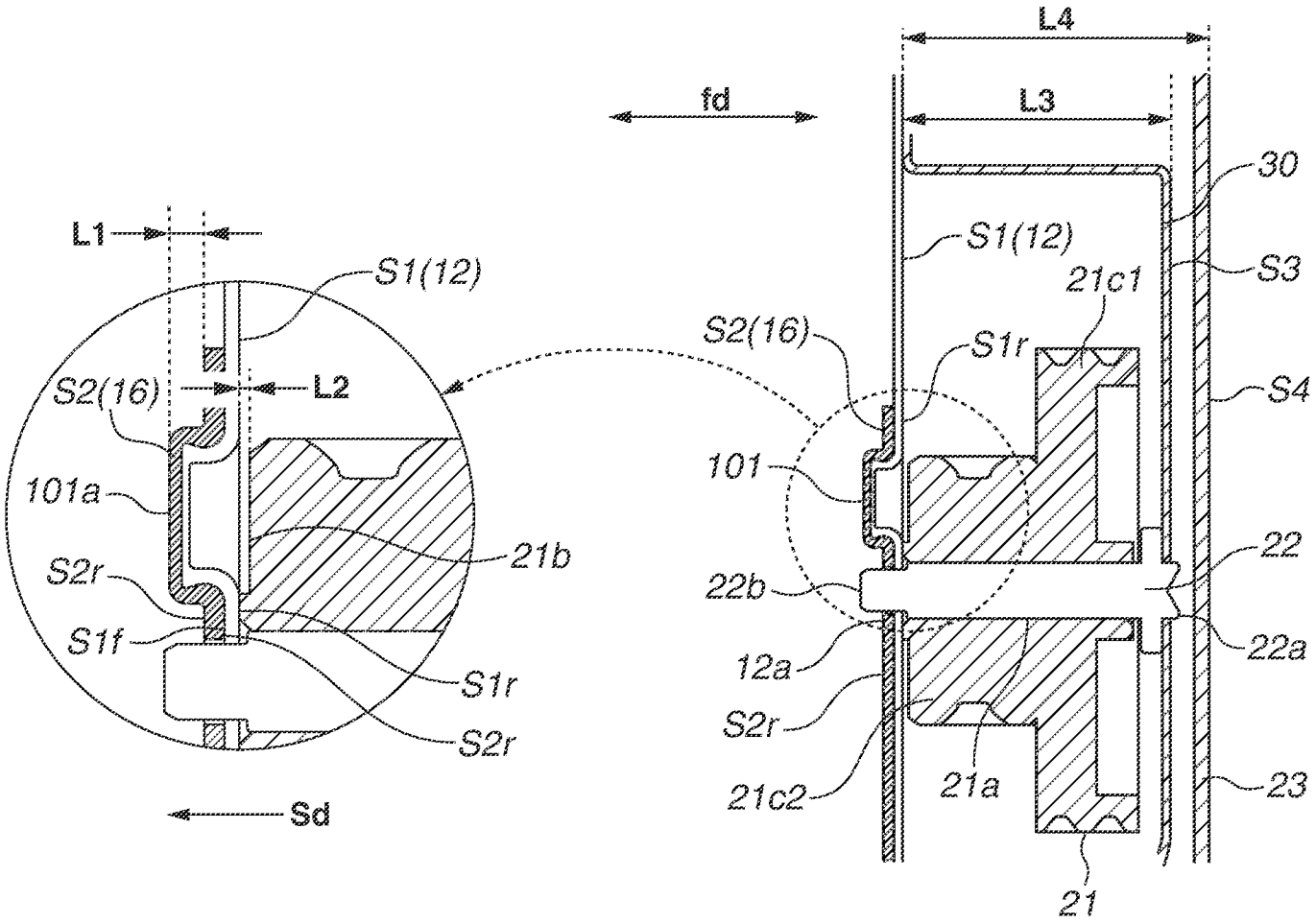
FIG. 6 is a sectional view illustrating an arrangement of a transmission gear and the fixing portion according to the first exemplary embodiment.

FIG. 6 is a sectional view illustrating the arrangement of a transmission gear 21 and the fixing portion 101 according to the present exemplary embodiment. FIG. 6 is a sectional view through a rotation center of the transmission gear 21, taken along the line X2-X2 of FIG. 5A.

As illustrated in FIG. 5A, the motor 38 includes a motor main body 38*b* and a pinion gear 38*a*. The motor main body 38*b* accommodates a rotor and a stator. The pinion gear 38*a* is attached to a motor shaft of the motor 38.

The motor main body 38*b* is disposed between the right side plate 12 and the left side plate 13 in the facing direction fd. The pinion gear 38*a* is disposed on the other side across the right side plate 12 from the motor main body 38*b*. In other words, the motor 38 is attached to the right side plate 12 in such a manner that the motor main body 38*b* is at a position on the interior side with respect to the right side plate 12 and the pinion gear 38*a* is at a position on the exterior side with respect to the right side plate 12 in the facing direction fd.

The image forming apparatus 1 includes the drive train 39 that transmits the driving force of the motor 38 to members to be driven. The drive train 39 includes a plurality of gears, which includes the transmission gear 21. The transmission gear 21 can be said to be a moving member movable with respect to the right side plate 12. In other words, the moving member according to the present exemplary embodiment is a rotation member, and more specifically, a gear. The transmission gear 21 moves with respect to the right side plate 12 in a direction along the first rear surface S1*r*. The direction of the rotation axis of the transmission gear 21 is in (desirably parallel to) the facing direction fd.

The gear cover 30 is attached to the right side plate 12, and a support shaft 22 is attached to the gear cover 30. An end 22*a* of the support shaft 22 in the axial direction of the support shaft 22 is a mechanical fastening portion. The end 22*a* is plastically deformed to be fixed to the gear cover 30. An other end 22*b* of the support shaft 22 in the axial direction of the support shaft 22 (the same as the direction of the rotation axis of the transmission gear 21) is inserted into a shaft hole 12*a* in the right side plate 12. The other end 22*b* of the support shaft 22 protrudes from the second rear surface S2*r*.

The transmission gear 21 has a gear hole 21*a*. The support shaft 22 is inserted into the gear hole 21*a*, whereby the transmission gear 21 is rotatably supported by the support shaft 22. In other words, the transmission gear 21 is attached to the right side plate 12 via the gear cover 30 and the support shaft 22.

The transmission gear 21 meshes with the pinion gear 38*a*. More specifically, the transmission gear 21 is a stepped gear including a large gear portion (first gear portion) 21*c*1 and a small gear portion (second gear portion) 21*c*2 having a diameter smaller than that of the large gear portion 21*c*1. With the large gear portion 21*c*1 in mesh with the pinion gear 38*a*, the transmission gear 21 is rotated by the driving force of the motor 38.

The small gear portion 21*c*2 is disposed between the large gear portion 21*c*1 and the first rear surface S1*r* in the facing direction fd. In other words, the small gear portion 21*c*2 is at a position closer to the first rear surface S1*r* in the facing direction fd than the large gear portion 21*c*1. A distance between the small gear portion 21*c*2 and the first rear surface S1*r* is less than a distance between the large gear portion 21*c*1 and the first rear surface S1*r*.

A right cover (exterior cover) 23 that is an exterior part of the image forming apparatus 1 is disposed outside the gear cover 30 in the facing direction fd. There is a gap between an outer surface S3 of the gear cover 30 and the right cover 23.

As illustrated in FIG. 5B, when seen in the facing direction fd, the projection 101*a* and the recess 101*c* of the fixing portion 101 have a circular shape. The facing direction fd can be referred to as an orthogonal direction orthogonal to the first facing surface S1*f*.

As illustrated in FIG. 5B, when seen in the facing direction fd, the transmission gear 21 is disposed so that the moving member at least partly overlaps the fixing portion 101. More specifically, when seen in the facing direction fd, the small gear portion 21*c*2 is at least partly over the fixing portion 101.

Next, the arrangement of the transmission gear 21, the right side plate 12 serving as the first sheet metal S1, and the rear scanner frame 16 serving as the second sheet metal S2 in the facing direction fd will be described.

As illustrated in FIG. 6, the transmission gear 21 faces the first rear surface S1*r*. An end of the transmission gear 21 is in contact with the first rear surface S1*r*.

The deformation direction Sd is from the first rear surface S1*r* toward the first facing surface S1*f*, which is a direction away from the transmission gear 21. Thus, the transmission gear 21 is disposed at a position on the side opposite to the projection 101*a* with respect to the first rear surface S1*r* in the deformation direction Sd and the facing direction fd. In other words, the transmission gear 21 is disposed at a position on one side of the first rear surface S1*r*, and the projection 101*a* is disposed at a position on the other side of the first rear surface S1*r*, in the deformation direction Sd and the facing direction fd. It can also be said that the transmission gear 21 is disposed on an upstream side of the projection 101*a* in the deformation direction Sd.

As illustrated in FIG. 6, the distance between the transmission gear 21 and the first rear surface S1*r* (a length of the gap between the transmission gear 21 and the first rear surface S1*r*) in the area where the fixing portion 101 and the transmission gear 21 overlap when seen in the facing direction fd is a length L2. In other words, the length L2 is the distance between an end face 21*b* of the transmission gear 21 (end face 21*b* of the small gear portion 21*c*2) and the first rear surface S1*r*. In the present exemplary embodiment, the length L2 is less than the projection length L1.

If both the transmission gear 21 and the projection 101*a* are disposed at positions on one side with respect to the first rear surface S1*r* in the deformation direction Sd and the facing direction fd, the length L2 is required to be longer than the projection length L1.

Since the transmission gear 21, the projection 101*a*, the first rear surface S1*r*, and the second rear surface S2*r* are arranged as described in the present exemplary embodiment, the transmission gear 21 can be disposed at a position close to the first rear surface S1*r* in the facing direction fd. In other words, the transmission gear 21 and the fixing portion 101 can be arranged in a space-saving manner in the facing direction fd. A length L3 from the first rear surface S1*r* to the outer surface S3 of the gear cover 30 and a length L4 from the first rear surface S1*r* to an external surface S4 of the right cover 23 can also be reduced. Consequently, the image forming apparatus 1 can be reduced in size.

According to the present exemplary embodiment, even with a configuration in which the transmission gear 21 is disposed at a position close to the first rear surface S1*r* in the facing direction fd, the fixing portion 101 and the transmission gear 21 can be arranged such that the fixing portion 101 and the transmission gear 21 overlap when seen in the facing direction fd. In other words, the degrees of freedom of design related to the arrangement of the transmission gear 21 and the fixing portions 101 can be improved.

<Fixing Portion of Comparative Example>

A fixing portion 102 of a comparative example will be described with reference to FIGS. 7A to 7C. In the comparative example, the first sheet metal S1 and the second sheet metal S2 are fixed with the fixing portion 102 instead of the fixing portion 101. More specifically, in the comparative example, the first sheet metal S1 and the second sheet metal S2 are fixed at the fixing portion 102 with a screw 100.

Figure 7C:
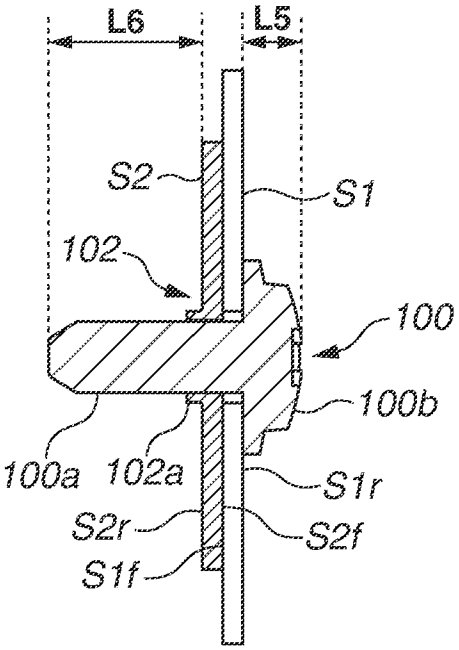
FIG. 7C is a sectional view of the fixing portion according to the comparative example.
Figure 7B:
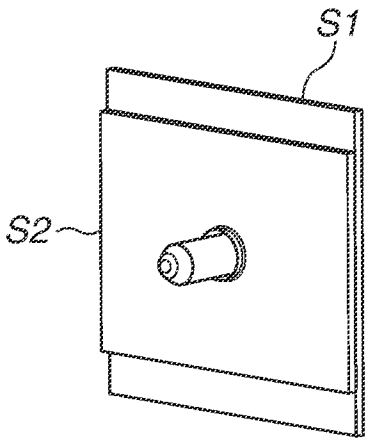
FIGS. 7A and 7B are perspective views of a fixing portion according to a comparative example.
Figure 7A:
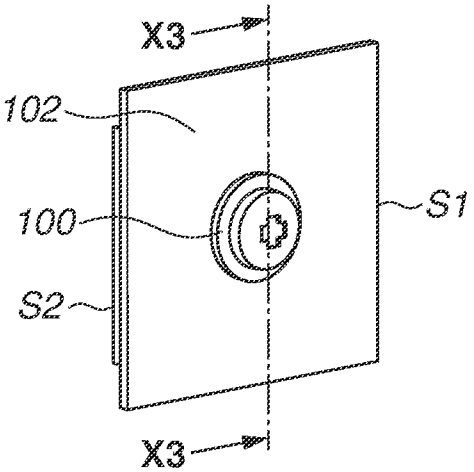

FIGS. 7A to 7C are diagrams for describing the fixing portion 102. FIGS. 7A and 7B are perspective views of the fixing portion 102. FIG. 7C is a sectional view of the fixing portion 102. Specifically, FIG. 7C is a sectional view taken along the line X3-X3 of FIG. 7A.

In the comparative example, the first sheet metal S1 and the second sheet metal S2 are stacked by bringing the first facing surface S1*f* and the second facing surface S2*f* in contact each other. The screw 100 is inserted in a direction from the first rear surface S1*r* toward the second rear surface S2*r*. A threaded portion 100*a* of the screw 100 is engaged with a thread groove 102*a* in the second sheet metal S2.

A screw head 100*b* of the screw 100 protrudes from the first rear surface S1*r* of the right side plate 12, and the threaded portion 100*a* protrudes from the second rear surface S2*r*. The amount of protrusion of the screw head 100*b* from the first rear surface S1*r* is a length L5, and the amount of protrusion of the threaded portion 100*a* from the second rear surface S2*r* is a length L6.

<Arrangement of Transmission Gear and Fixing Portion in Comparative Example>

Figure 8:
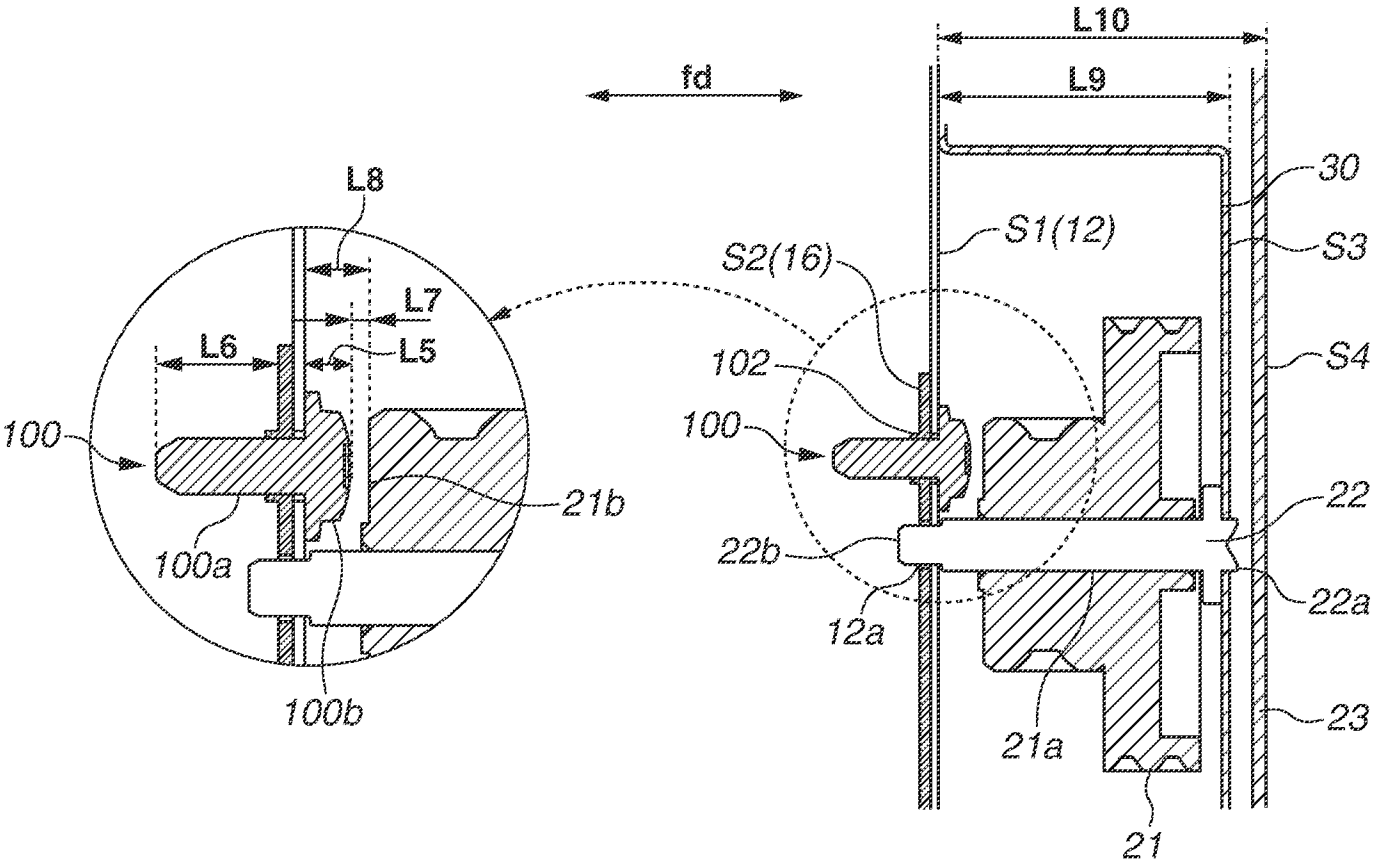
FIG. 8 is a sectional view illustrating an arrangement of a transmission gear and the fixing portion according to the comparative example.

The arrangement of the transmission gear 21 and the fixing portion 102 in the comparative example will be described with reference to FIG. 8. FIG. 8 is a sectional view illustrating the arrangement of the transmission gear 21 and the fixing portion 102 according to the comparative example.

The fixing portion 102 of the comparative example is disposed at the same position in the directions orthogonal to the facing direction fd as the fixing portion 101. Thus, when seen in the facing direction fd, the transmission gear 21 is disposed so that the moving member at least partly overlaps the fixing portion 102. More specifically, when seen in the facing direction fd, the small gear portion 21*c*2 is at least partly over the fixing portion 102.

In the comparative example, there is a gap of a length L7 between the end face 21*b* of the transmission gear 21 and the screw head 100*b* to avoid contact between the transmission gear 21 and the screw head 100*b*. A length L8 from the first rear surface S1*r* to the end face 21*b* of the transmission gear 21 is equal to the sum of the length L5 and the length L7.

In the comparative example, a distance from the first rear surface S1*r* to the outer surface S3 of the gear cover 30 is a length L9, and a distance from the first rear surface S1*r* to the external surface S4 of the right cover 23 is a length L10. Even with the length L7 being the same as the length L2, the length L9 is longer than the length L3, and the length L10 is longer than the length L4, by the length L5.

If the screw 100 is attached such that the threaded portion 100*a* protrudes from the first rear surface S1*r*, the length L9 is longer than the length L3, and the length L10 is longer than the length L4, by the length L6.

As described above, in the configuration of the comparative example, if the transmission gear 21 is disposed so that the moving member at least partly overlaps the fixing portion 102 when seen in the facing direction fd, the arrangement space of the fixing portion 102 and the transmission gear 21 in the facing direction fd increases as compared to the first exemplary embodiment. If the arrangement space of the fixing portion 102 and the transmission gear 21 in the facing direction fd are set to be the same as in the first exemplary embodiment, the transmission gear 21 and the fixing portion 102 are required to be disposed at positions not overlapping each other when seen in the facing direction fd.

By contrast, according to the configuration of the first exemplary embodiment, the transmission gear 21 and the fixing portion 101 can be arranged in a space-saving manner in the facing direction fd. This can improve the degrees of freedom of design related to the arrangement of the transmission gear 21 and the fixing portion 101.

MODIFICATION EXAMPLE

A modification example will be described with reference to FIG. 9. While, in the first exemplary embodiment, the transmission gear 21 is described as the moving member movable with respect to the right side plate 12, the moving member does not need to be a gear.

Figure 9:
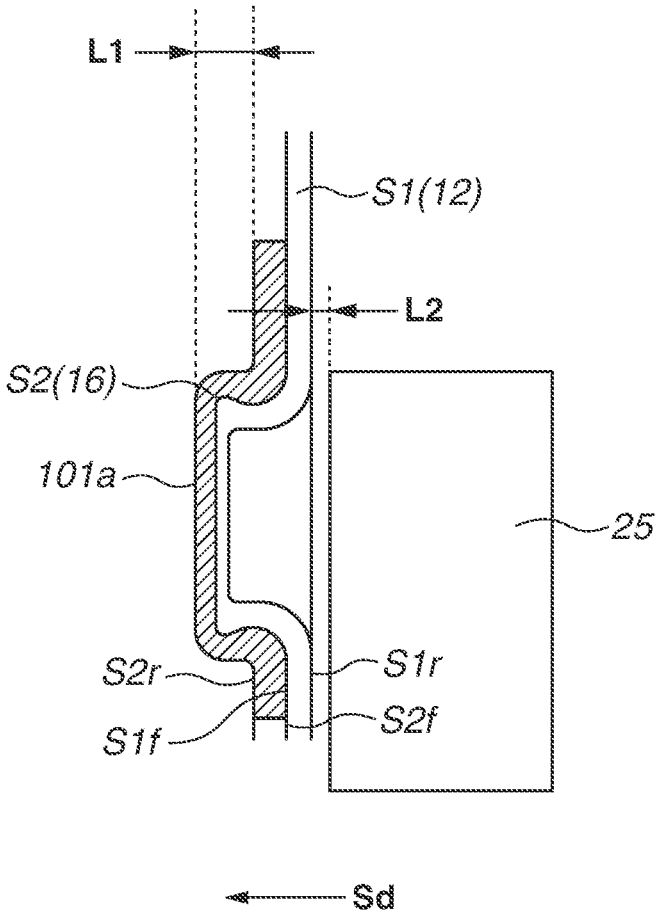
FIG. 9 is a sectional view illustrating an arrangement of a moving member and a fixing portion according to a modification example.

FIG. 9 is a sectional view illustrating the arrangement of a moving member 25 and a fixing portion 101 according to the modification example. As illustrated in FIG. 9, in the modification example, the moving member 25 instead of the transmission gear 21 of the first exemplary embodiment is disposed at a position with a gap of a length L2 from the fixing portion 101.

The moving member 25 performs a rotary motion or linear motion with respect to the right side plate 12. Examples of the moving member 25 include a member that performs a rotary motion with respect to the right side plate 12 like a pulley, and a member that reciprocates with respect to the right side plate 12 like a link and a cam. The moving member 25 is configured to move with respect to the right side plate 12 in a direction along the first rear surface S1*r*. With this configuration, the fixing portion 101 and the moving member 25 can be disposed close to each other.

A second exemplary embodiment will be described. Redundant descriptions of similarities of the second exemplary embodiment to the first exemplary embodiment will be omitted. Portions similar to the configuration described in the first exemplary embodiment will be denoted by the same reference numerals as in the first exemplary embodiment.

Figure 10C:
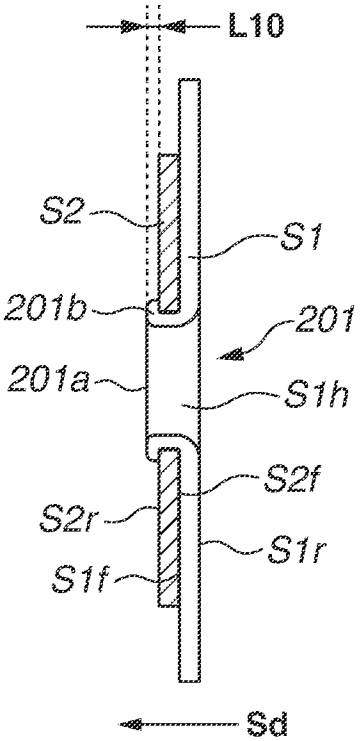
FIG. 10C is a sectional view of the fixing portion according to the second exemplary embodiment.
Figure 10B:
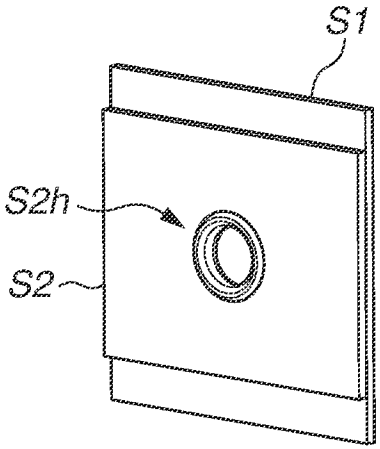
FIGS. 10A and 10B are perspective views of a fixing portion according to a second exemplary embodiment.
Figure 10A:
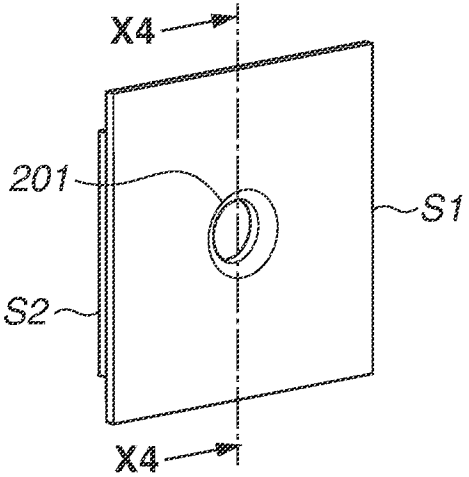

The second exemplary embodiment will be described with reference to FIGS. 10A to 10C. FIGS. 10A to 10C are diagrams illustrating a fixing portion 201 according to the second exemplary embodiment. FIGS. 10A and 10B are perspective views of the fixing portion 201. FIG. 10C is a sectional view of the fixing portion 201. Specifically, FIG. 10C is a sectional view taken along the line X4-X4 of FIG. 10A.

In the second exemplary embodiment, a first sheet metal S1 and a second sheet metal S2 are fixed by the fixing portion 201 instead of the fixing portion 101 according to the first exemplary embodiment. The fixing portion 101 of the first exemplary embodiment is formed by deforming the first sheet metal S1 and the second sheet metal S2. In the second exemplary embodiment, the first sheet metal S1 and the second sheet metal S2 are fixed to each other by deforming the first sheet metal S1.

More specifically, the fixing portion 201 of the present exemplary embodiment is formed by deforming the first sheet metal S1. The fixing portion 201 can be referred to as a mechanical fastening portion, without using a rivet, that is formed by plastic deformation of the first sheet metal S1.

The first sheet metal S1 is deformed in a deformation direction Sd and gets into a hole S2*h* in the second sheet metal S2 to form a projection 201*a*. In other words, the fixing portion 201 includes the projection 201*a* projecting from a second rear surface S2*r* of the second sheet metal S2 in the deformation direction Sd. The projection 201*a* is formed by deforming the first sheet metal S1. A height of the projection 201*a* projecting from the second rear surface S2*r* is a length L10. The fixing portion 201 according to the present exemplary embodiment is formed such that there is no projection from a first rear surface S1*r*.

The fixing portion 201 can be formed by flanging and clinching. A part of the first sheet metal S1 is deformed into a cylindrical shape having a hole S1*h*, and the cylindrical shape penetrates through the hole S2*h*. The end of the cylindrical shape penetrating through the hole S2*h* is further deformed into a locking portion 201*b*. With the locking portion 201*b*, separation of the first sheet metal S1 and the second sheet metal S2 can be further reliably prevented.

In separation of a front scanner frame 15, a rear scanner frame 16, and a rear frame 17 from the left side plate 13 and the right side plate 12, at least either the front scanner frame 15, the rear scanner frame 16, and the rear frame 17 or the left side plate 13 and the right side plate 12 are plastically deformed.

Also, in the present exemplary embodiment, the left side plate 13 and the right side plate 12 correspond to the first sheet metal S1, and the front scanner frame 15, the rear scanner frame 16, and the rear frame 17 correspond to the second sheet metal S2, which means that the projections 201*a* project toward the space between the left side plate 13 and the right side plate 12. In other words, the projections 201*a* project toward the inside of an apparatus main body 1A in the facing direction fd.

Effects similar to those of the first exemplary embodiment can be obtained by arranging the transmission gear 21, the projections 201*a*, the first rear surface S1*r*, and the second rear surface S2*r* the same as that of the transmission gear 21, the projections 101*a*, the first rear surface S1*r*, and the second rear surface S2*r* according to the first exemplary embodiment. More specifically, the transmission gear 21 is disposed at a position on the side opposite to the projections 201*a* with respect to the first rear surface S1*r* and faces the first rear surface S1*r* in the deformation direction Sd.

While the projections 201*a* according to the present exemplary embodiment are formed by flanging and clinching, other methods such as pressure clinching may be used to deform the first sheet metal S1 to form projections. Even in such a case, effects similar to those of the first exemplary embodiment can be obtained by arranging the transmission gear 21, the projections, the first rear surface S1*r*, and the second rear surface S2*r* the same as that of the transmission gear 21, the projections 101*a*, the first rear surface S1*r*, and the second rear surface S2*r* according to the first exemplary embodiment.

Even in the present exemplary embodiment, a moving member 25 can be used (see FIG. 9 of the first exemplary embodiment) instead of the transmission gear 21.

A third exemplary embodiment will be described. The redundant descriptions of similarities of the third exemplary embodiment to the first exemplary embodiment will be omitted. Portions similar to the configuration described in the first exemplary embodiment will be denoted by the same reference numerals as in the first exemplary embodiment.

<Arrangement of Electronic Substrate and Fixing Portions>

The arrangement of an electronic substrate 28 and fixing portions 101 according to the present exemplary embodiment will be described with reference to FIGS. 11A, 11B, and 12.

Figure 11A:
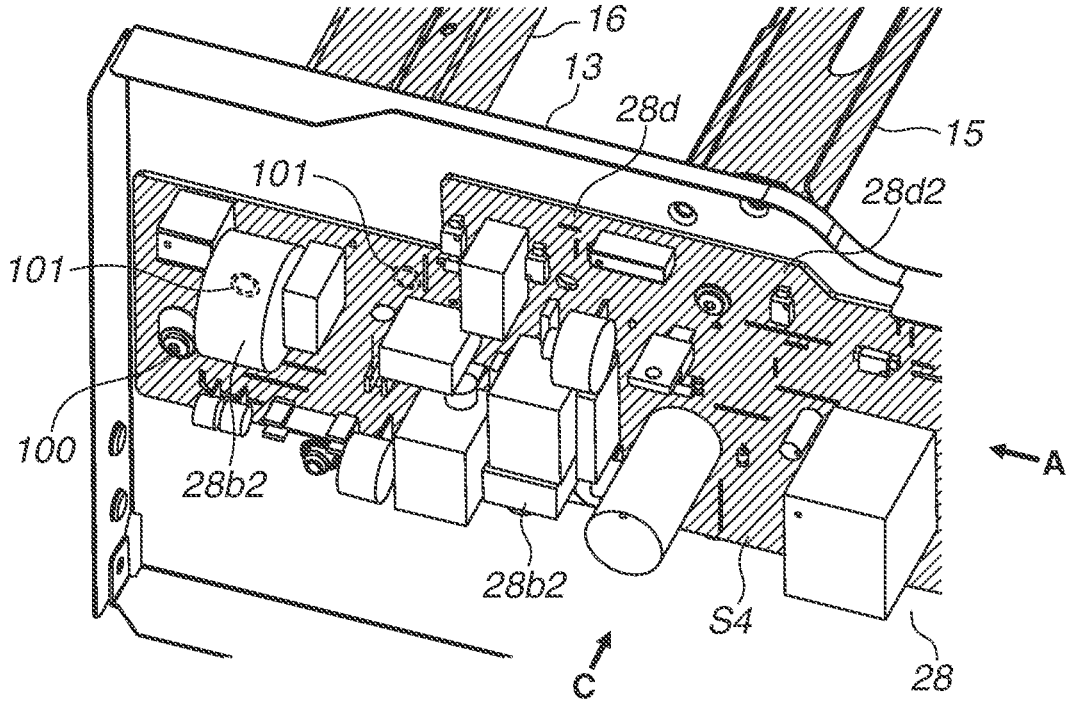
FIGS. 11A and 11B are diagrams illustrating an electronic substrate.
Figure 11B:
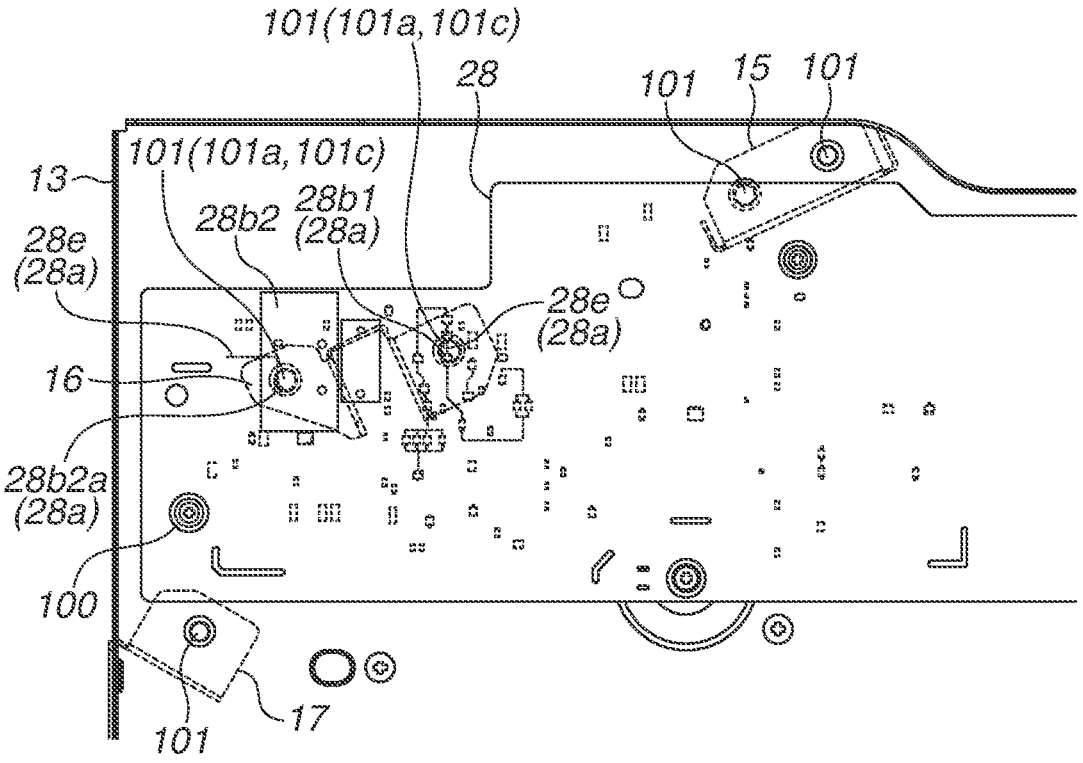

FIGS. 11A and 11B are diagrams illustrating the electronic substrate 28. More specifically, FIG. 11A is a perspective view of and around a range Lsa illustrated in FIG. 3A. FIG. 11B is a side view of and around the range Lsa, seen in a facing direction fd (direction of the arrow C).

Figure 12:
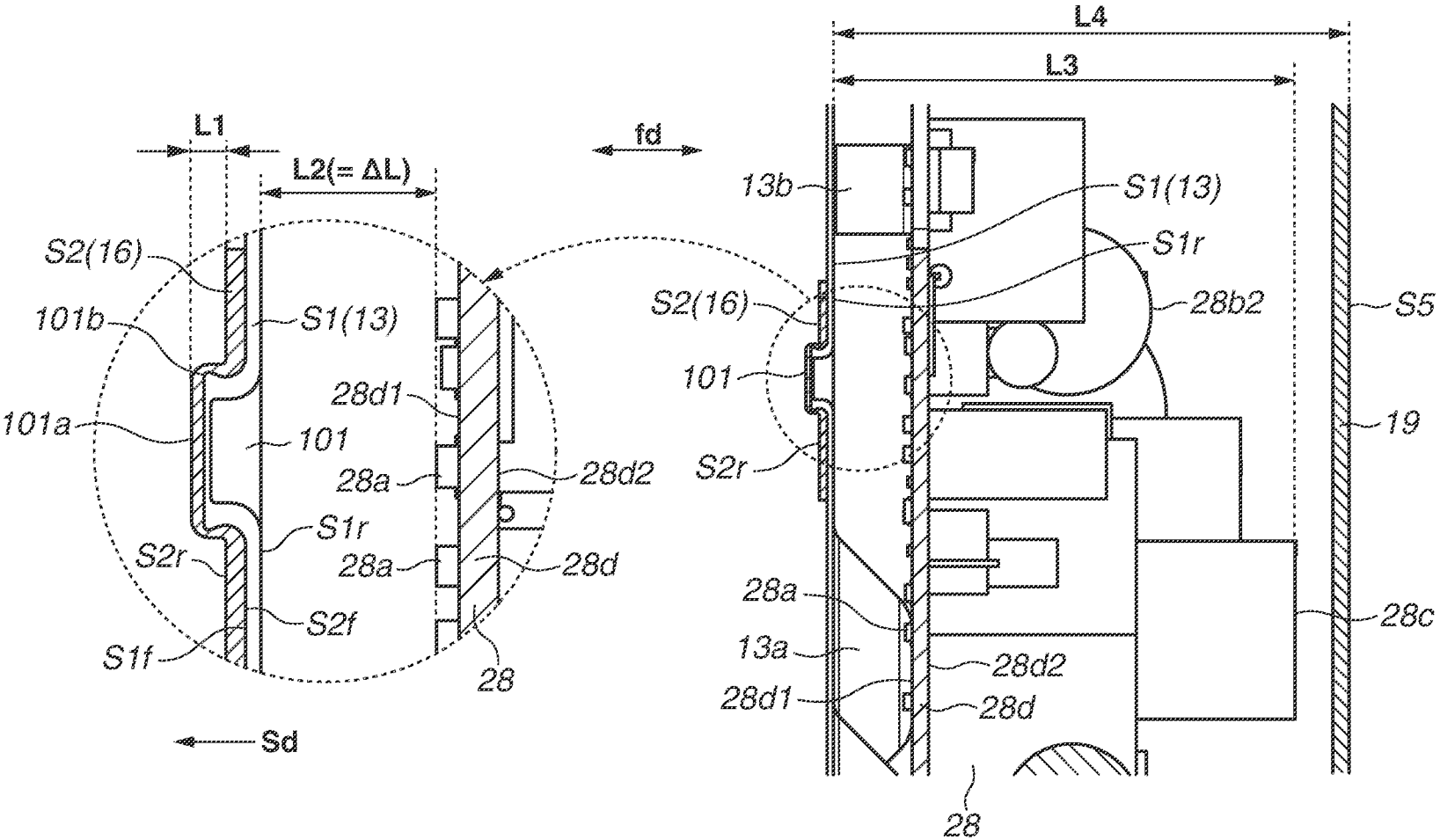
FIG. 12 is a sectional view illustrating an arrangement of an electronic substrate and a fixing portion according to a third exemplary embodiment.

FIG. 12 is a sectional view illustrating the arrangement of the electronic substrate 28 and the fixing portion 101 according to the present exemplary embodiment.

As illustrated in FIGS. 11A, 11B, and 12, the electronic substrate 28 includes a printed wiring board 28*d* that is an insulating plate member on which a pattern 28*e* is printed. The printed wiring board 28*d* has a first surface (pattern surface) 28*d*1 where the pattern 28*e* is disposed, and a second surface (parts surface) 28*d*2 that is on a side opposite to the first side 28*d*1. In FIG. 11B, the pattern 28*e* is omitted in part.

Electronic parts 28*b*2 are attached to the second surface 28*d*2. Examples of the electronic parts 28*b*2 include a resistor, a capacitor, and an inductor. Element main bodies of the electronic parts 28*b*2 are disposed on the second surface 28*d*2, and terminals 28*b*2*a* connected to the element main bodies penetrate through the printed wiring board 28*d* from the second surface 28*d*2 to the first surface 28*d*1. Ends of the terminals 28*b*2*a* are electrically connected to the pattern 28*e* by soldering. An electronic part 28*b*1, such as an integrated circuit, may be disposed on the first surface 28*d*1 as well. The electronic part 28*b*1 is connected to the pattern 28*e*.

As illustrated in FIG. 12, the electronic substrate 28 includes electric conductive portions 28*a* where a current flows. The electric conductive portions 28*a* are disposed on the first surface 28*d*1. Examples of the electric conductive portions 28*a* include the pattern 28*e*, the electronic part 28*b*1, and the terminals 28*b*2*a* of the electronic parts 28*b*2. While, in FIG. 12, the electric conductive portions 28*a* protrude from the first surface 28*d*1, the electric conductive portions 28*a* do not need to protrude from the first surface 28*d*1.

A left cover (exterior cover) 19 that is an exterior part of the image forming apparatus 1 is disposed outside the electronic substrate 28 in the facing direction fd. There is a gap between end faces 28*c* of the electronic parts 28*b*2 and the left cover 19.

As illustrated in FIG. 11B, projections 101*a* and recesses 101*c* of the fixing portions 101 have a circular shape when seen in the facing direction fd. The facing direction fd can be referred to as an orthogonal direction orthogonal to a first facing surface S1*f*.

As illustrated in FIG. 11B, the electronic substrate 28 is disposed so that the moving member at least partly overlaps the fixing portions 101 when seen in the facing direction fd. In the present exemplary embodiment, electric conductive portions 28*a* are at least partly over fixing portions 101 when seen in the facing direction fd.

The arrangement of the electronic substrate 28, a left side plate 13 serving as a first sheet metal S1, and a rear scanner frame 16 serving as a second sheet metal S2 in the facing direction fd will be described.

As illustrated in FIG. 12, the printed wiring board 28*d* of the electronic substrate 28 is received by receiving portions (drawn shapes 13*a* and bent portions 13*b*) of the left side plate 13 and supported by the left side plate 13. The electronic substrate 28 faces the first rear surface S1*r*. More specifically, the electronic substrate 28 is disposed with the first side 28*d*1 facing the first rear surface S1*r*. Consequently, the electric conductive portions 28*a* face the first rear surface S1*r*.

A deformation direction Sd is from the first rear surface S1*r* toward the first facing surface S1*f*, which is a direction away from the electronic substrate 28. Thus, the electronic substrate 28 is disposed at a position on a side opposite to the projections 101*a* with respect to the first rear surface S1*r* in the deformation direction Sd and the facing direction fd. In other words, the electronic substrate 28 is disposed on one side of the first rear surface S1*r*, and the projections 101*a* are disposed on the other side of the first rear surface S1*r*, in the deformation direction Sd and the facing direction fd. It can be also said that the electronic substrate 28 is disposed an upstream side of the projections 101*a* in the deformation direction Sd.

As illustrated in FIG. 12, the distance between the electric conductive portions 28*a* of the electronic substrate 28 and the first rear surface S1*r* (length of the gap between the electric conductive portions 28*a* of the electronic substrate 28 and the first rear surface S1*r*) in an area where a fixing portion 101 and the electronic substrate 28 overlap when seen in the facing direction fd is a length L2.

When the image forming apparatus 1 is in use, a current flows from the power supply to the electric conductive portions 28*a* of the electronic substrate 28. If the distance between the left side plate 13 and the electric conductive portions 28*a* is not sufficient, a discharge can occur from the electric conductive portions 28*a* to the left side plate 13, which may damage the electronic substrate 28. The discharge between the left side plate 13 and the electric conductive portions 28*a* is prevented by air present between the left side plate 13 and the electric conductive portions 28*a*. The distance for preventing the discharge between the left side plate 13 and the electric conductive portions 28*a* will be referred to as an insulating length ΔL. The insulating length ΔL varies in accordance with the types of electric conductive portions 28*a* and the magnitude of the voltage applied to the electric conductive portions 28*a*.

As described above, the electric conductive portions 28*a* are disposed at positions over the fixing portions 101 when seen in the facing direction fd. Meanwhile, the fixing portions 101 of the present exemplary embodiment are formed such that the projections 101*a* project from the second rear surface S2*r* but not from the first rear surface S1*r*. Thus, the length L2 can be the same as the insulating length ΔL.

If both the electronic substrate 28 and the projections 101*a* are on one side of the first rear surface S1*r* in the deformation direction Sd and the facing direction fd, the length L2 is set to be the sum of the insulating length ΔL and the projection length L1 of the projections 101*a*.

Since the electronic substrate 28, the projections 101*a*, the first rear surface S1*r*, and the second rear surface S2*r* are arranged as described in the present exemplary embodiment, the electronic substrate 28 can be disposed close to the first rear surface S1*r* in the facing direction fd. In other words, the electronic substrate 28 and the fixing portions 101 can be arranged in a space-saving manner in the facing direction fd. A length L3 from the first rear surface S1*r* to the end face 28*c* of the specific electronic part 28*b*2, and a length L4 from the first rear surface S1*r* to an external surface S5 of the left cover 19 can also be reduced. As a result, the image forming apparatus 1 can be reduced in size.

Even in a case where the electric conductive portions 28*a* are disposed at positions not over the fixing portions 101 when seen in the facing direction fd, the distance between the projections 101*a* and the electric conductive portions 28*a* still decreases if the projections 101*a* protrude from the first rear surface S1*r*. Thus, the fixing portions 101 are formed to protrude from the second rear surface S2*r*, which enables close arrangement of the fixing portions 101 and the electric conductive portions 28*a*.

According to the configuration of the present exemplary embodiment, the fixing portions 101 and the electronic substrate 28 can be arranged such that the fixing portions 101 and the electric conductive portions 28*a* overlap when seen in the facing direction fd, even in a case where the electronic substrate 28 is disposed at a position close to the first rear surface S1*r*. In other words, the degrees of freedom of design related to the arrangement of the electronic substrate 28 and the fixing portions 101 can be improved.

<Fixing Portions of Comparative Example>

Fixing portions 102 of a comparative example will be described with reference to FIGS. 13A to 13C. In the comparative example, the first sheet metal S1 and the second sheet metal S2 are fixed by the fixing portions 102 instead of the fixing portions 101. More specifically, in the comparative example, the first sheet metal S1 and the second sheet metal S2 are fixed by the fixing portions 102 with screws 100.

Figure 13C:
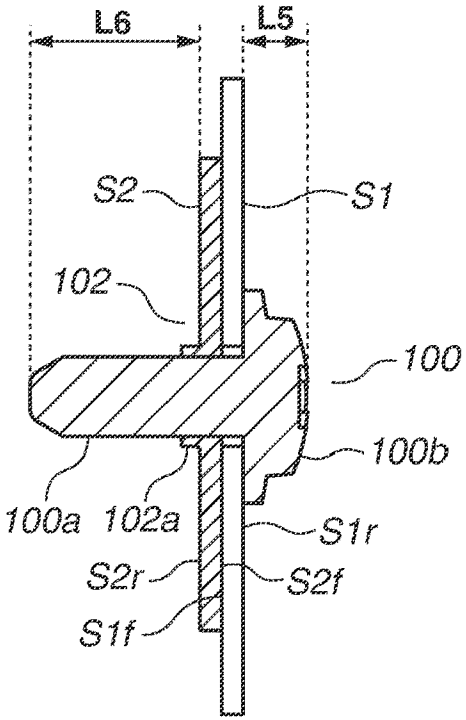
FIG. 13C is a sectional view of the fixing portion according to the comparative example of the third exemplary embodiment.
Figure 13B:
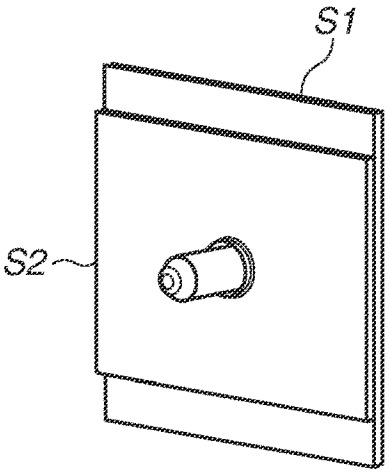
FIGS. 13A and 13B are perspective views of a fixing portion according to a comparative example of the third exemplary embodiment.
Figure 13A:
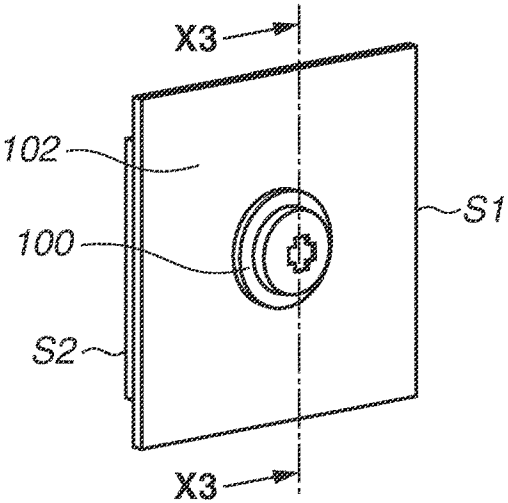

FIGS. 13A to 13C are diagrams for describing the fixing portions 102. FIGS. 13A and 13B are perspective views of the fixing portion 102. FIG. 13C is a sectional view of the fixing portion 102. Specifically, FIG. 13C is a sectional view taken along the line X3-X3 of FIG. 13A.

In the comparative example, the first sheet metal S1 and the second sheet metal S2 are stacked by bringing the first facing surface S1*f* and a second facing surface S2*f* in contact each other. A screw 100 is inserted in a direction from a first rear surface S1*r* toward a second rear surface S2*r*. A threaded portion 100*a* of the screw 100 is engaged with a thread groove 102*a* in the second sheet metal S2.

A screw head 100*b* of the screw 100 protrudes from the first rear surface S1*r* of the first sheet metal S1, and the threaded portion 100*a* protrudes from the second rear surface S2*r*. The amount of protrusion of the screw head 100*b* from the first rear surface S1*r* is a length L5, and the amount of protrusion of the threaded portion 100*a* from the second rear surface S2*r* is a length L6.

<Arrangement of Electronic Substrate and Fixing Portions of Comparative Example>

Figure 14:
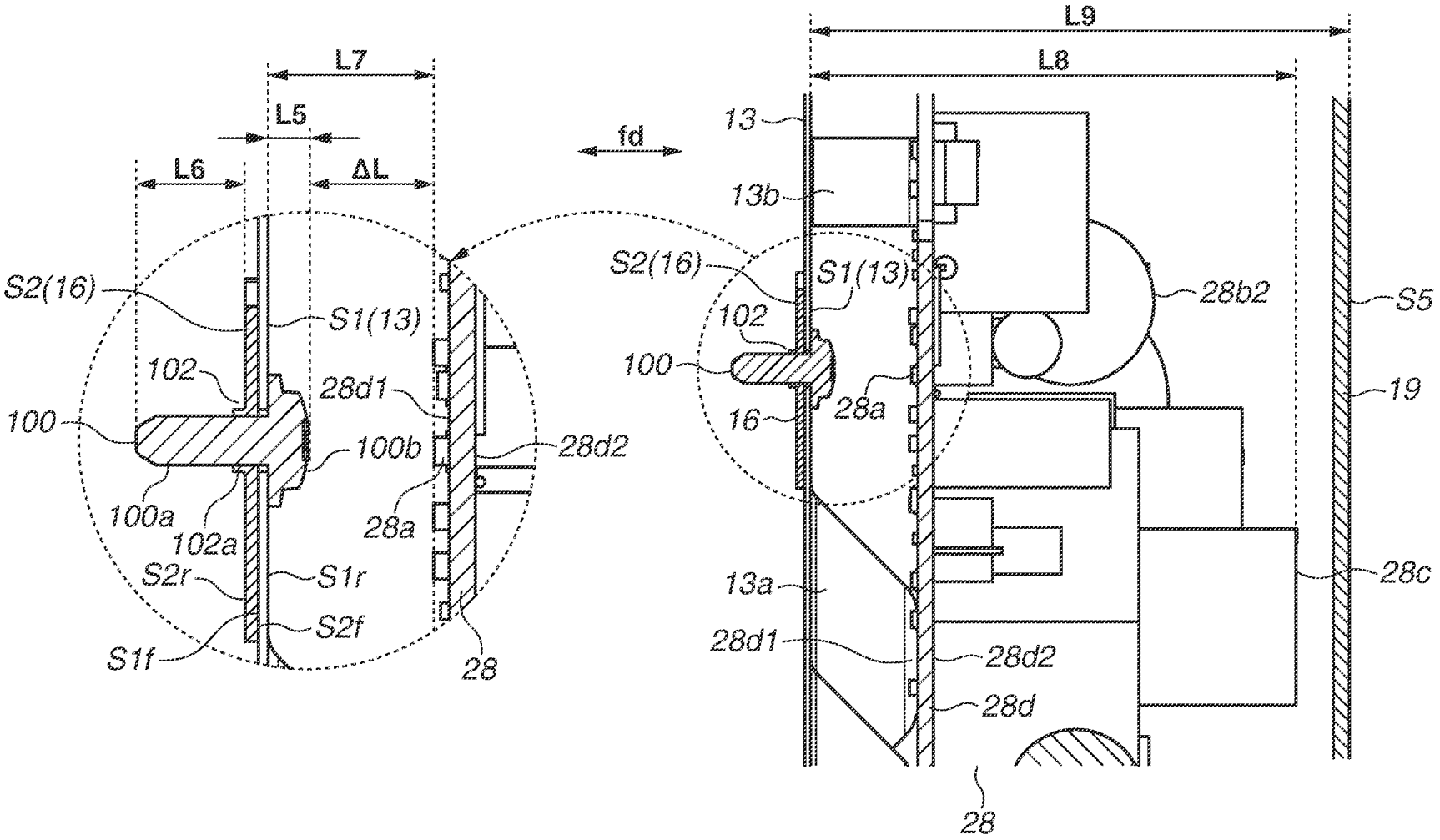
FIG. 14 is a sectional view illustrating an arrangement of an electronic substrate and the fixing portion according to the comparative example of the third exemplary embodiment.

The arrangement of the electronic substrate 28 and the fixing portions 102 of the comparative example will be described with reference to FIG. 14. FIG. 14 is a sectional view illustrating the arrangement of the electronic substrate 28 and the fixing portion 102 according to the comparative example.

In a direction orthogonal to the facing direction fd, the fixing portions 102 of the comparative example are disposed at the same positions as the fixing portions 101. The electronic substrate 28 is thus disposed so that the moving member at least partly overlaps the fixing portions 102 when seen in the facing direction fd. More specifically, electric conductive portions 28*a* are at least partly over fixing portions 102 when seen in the facing direction fd.

In the comparative example, there is a gap of length L7 between the electric conductive portions 28*a* of the electronic substrate 28 and the screw heads 100*b* to avoid occurrence of discharge from the electronic substrate 28 to the screw heads 100*b*. The length L7 is greater than the sum of the insulating length ΔL and the length L5.

In the comparative example, the distance from the first rear surface S1*r* to the end face 28*c* of the specific electronic part 28*b*2 is a length L8, and the distance from the first rear surface S1*r* to the external surface S5 of the left cover 19 is a length L9. Since the length L7 is desirably greater than the sum of the insulating length ΔL and the length L5, the length L8 is longer than the length L3, and the length L9 is longer than the length L4, by at least the length L5.

If the screw 100 is attached such that the threaded portion 100*a* protrudes from the first rear surface S1*r*, the length L7 is set to be longer than the sum of the insulating length ΔL and the length L6. Thus, the length L9 is longer than the length L3, and the length L10 is longer than the length L4, by at least the length L6.

As described above, according to the configuration of the comparative example, if the electric conductive portions 28*a* are disposed at positions at least partly over the fixing portions 102 when seen in the facing direction fd, the arrangement space of the fixing portions 102 and the electronic substrate 28 in the facing direction fd increases as compared to the third exemplary embodiment. In a case where the arrangement space of the fixing portions 102 and the electronic substrate 28 in the facing direction fd is set to be the same as those in the third exemplary embodiment, the electric conductive portions 28*a* are disposed at positions not over the fixing portions 102 when seen in the facing direction fd.

By contrast, according to the configuration of the third exemplary embodiment, the electronic substrate 28 and the fixing portions 101 can be arranged in a space-saving manner in the facing direction fd. This can improve the degrees of freedom of design related to the arrangement of the electronic substrate 28 and the fixing portions 101.

A fourth exemplary embodiment will be described. In principle, the redundant descriptions of similarities of the fourth exemplary embodiment to the third exemplary embodiment will be omitted. Portions similar to the configuration described in the third exemplary embodiment will be denoted by the same reference numerals.

Figure 15C:
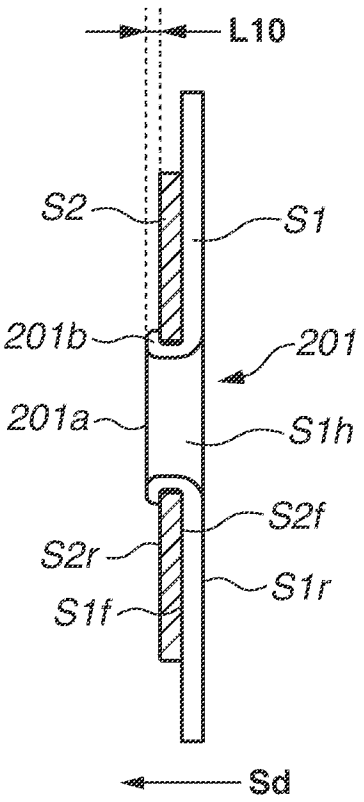
FIG. 15C is a sectional view of the fixing portion according to the fourth exemplary embodiment.
Figure 15B:
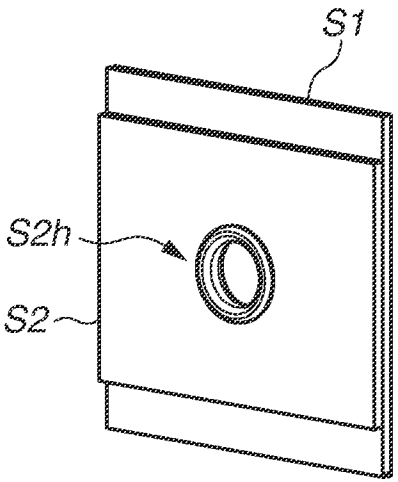
FIGS. 15A and 15B are perspective views of a fixing portion according to a fourth exemplary embodiment.
Figure 15A:
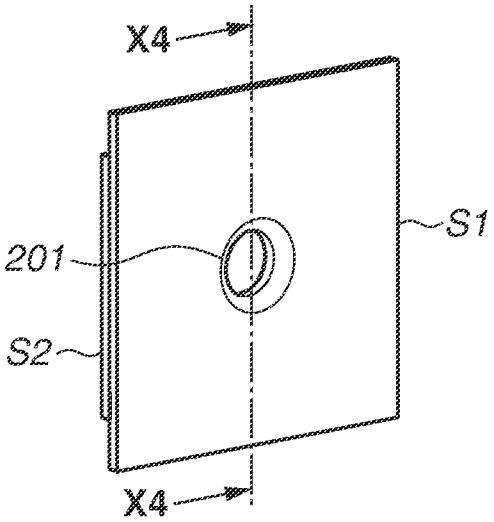

The fourth exemplary embodiment will be described with reference to FIGS. 15A to 15C. FIGS. 15A to 15C are diagrams for describing a fixing portion 201 according to the fourth exemplary embodiment. FIGS. 15A and 15B are perspective views of the fixing portion 201. FIG. 15C is a sectional view of the fixing portion 201. Specifically, FIG. 15C is a sectional view taken along the line X4-X4 of FIG. 15A.

In the fourth exemplary embodiment, a first sheet metal S1 and a second sheet metal S2 are fixed by the fixing portion 201 instead of the fixing portion 101 according to the third exemplary embodiment. The fixing portion 101 of the third exemplary embodiment is formed by deforming the first sheet metal S1 and the second sheet metal S2. In the fourth exemplary embodiment, the first sheet metal S1 and the second sheet metal S2 are fixed to each other by deforming the first sheet metal S1.

In other words, the fixing portion 201 of the present exemplary embodiment is formed by deforming the first sheet metal S1. The fixing portion 201 can be referred to as a mechanical fastening portion, without using a rivet, which has been formed by using plastic deformation of the first sheet metal S1.

The first sheet metal S1 is deformed in a deformation direction Sd and gets into a hole S2*h* in the second sheet metal S2 to form a projection 201*a*. In other words, the fixing portion 201 includes the projection 201*a* projecting from a second rear surface S2*r* of the second sheet metal S2 in the deformation direction Sd. The projection 201*a* is formed by deforming the first sheet metal S1. The height by which the projection 201*a* projects from the second rear surface S2*r* is a length L10. The fixing portion 201 according to the present exemplary embodiment is formed such that no projection is formed on a first rear surface S1*r*.

The fixing portion 201 can be formed by so-called burring caulking. A part of the first sheet metal S1 is deformed into a cylindrical shape having a hole S1*h*, and the cylindrical shape penetrates through the hole S2*h*. The end of the cylindrical shape penetrating through the hole S2*h* is further deformed into a locking portion 201*b*. The locking portion 201*b* can further reliably prevent separation of the first sheet metal S1 and the second sheet metal S2.

If a front scanner frame 15, a rear scanner frame 16, and a rear frame 17 are separated from the left side plate 13 and the right side plate 12, at least either the front scanner frame 15, the rear scanner frame 16, and the rear frame 17 or the left side plate 13 and the right side plate 12 are plastically deformed.

Even in the present exemplary embodiment, the left side plate 13 and the right side plate 12 correspond to the first sheet metal S1, and the front scanner frame 15, the rear scanner frame 16, and the rear frame 17 correspond to the second sheet metal S2. Thus, the projections 201*a* project toward the space between the left side plate 13 and the right side plate 12. In other words, the projections 201*a* project toward the inside of an apparatus main body 1A in the facing direction fd.

Effects similar to those of the third exemplary embodiment can be obtained by setting the arrangement of the electronic substrate 28, the projections 201*a*, the first rear surface S1*r*, and the second rear surface S2*r* to be the same as that of the electronic substrate 28, the projections 101*a*, the first rear surface S1*r*, and the second rear surface S2*r* according to the third exemplary embodiment. More specifically, the electronic substrate 28 is disposed at a position that is opposite to the projections 201*a* with respect to the first rear surface S1*r* and faces the first rear surface S1*r* in the deformation direction Sd.

While the projections 201*a* according to the present exemplary embodiment are formed by burring caulking, other methods such as pressure clinching may be used to deform the first sheet metal S1 to form projections. Even in such a case, effects similar to those of the third exemplary embodiment can be obtained by setting the arrangement of the electronic substrate 28, the projections 201*a*, the first rear surface S1*r*, and the second rear surface S2*r* to be the same as that of the electronic substrate 28, the projections 101*a*, the first rear surface S1*r*, and the second rear surface S2*r* according to the third exemplary embodiment.

As described above, according to an exemplary embodiment of the present disclosure, the conventional technique can be further developed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Applications No. 2023-012438, filed Jan. 31, 2023, and No. 2023-012436, filed Jan. 31, 2023, which are hereby incorporated by reference herein in their entirety.

What is claimed is:

1. An image forming apparatus for forming an image on a recording material, the image forming apparatus comprising:

a first sheet metal including a first facing surface and a first rear surface opposite to the first facing surface;

a second sheet metal that is fixed to the first sheet metal at a fixing portion and including a second facing surface facing the first facing surface and a second rear surface opposite to the second facing surface; and a moving member configured to be movable with respect to the first sheet metal, wherein the moving member is disposed so that the moving member at least partly overlaps the fixing portion when seen in an orthogonal direction that is orthogonal to the first facing surface, wherein the first sheet metal is deformed in a first direction from the first rear surface toward the first facing surface in such a manner that the fixing portion is formed, and the fixing portion includes a projection projecting from the second rear surface in the first direction, and wherein the moving member is disposed at a position that is on an opposite side of the first rear surface from the projection and faces the first rear surface in the first direction.

2. The image forming apparatus according to claim 1, wherein the moving member is a rotation member.

3. The image forming apparatus according to claim 2, wherein the rotation member is a gear.

4. The image forming apparatus according to claim 3, wherein the gear is a stepped gear including a first gear portion and a second gear portion having a diameter smaller than that of the first gear portion, and wherein, when seen in the orthogonal direction, the second gear portion is disposed so that the moving member at least partly overlaps the fixing portion.

5. The image forming apparatus according to claim 4, wherein a distance between the second gear portion and the first rear surface in the first direction is less than that between the first gear portion and the first rear surface.

6. The image forming apparatus according to claim 1, wherein a distance between the moving member and the first rear surface in the first direction in an area where the fixing portion and the moving member at least partly overlap when seen in the orthogonal direction is less than a projection height by which the projection projects from the second rear surface.

7. The image forming apparatus according to claim 1, wherein the fixing portion is a mechanical fastening portion, and the projection is formed by deforming the second sheet metal, and wherein the first sheet metal is deformed to form a recess in the first rear surface toward the first facing surface.

8. The image forming apparatus according to claim 1, wherein the projection is formed by deforming the first sheet metal.

9. The image forming apparatus according to claim 1, wherein, when seen in the orthogonal direction, the projection has a circular shape.

10. The image forming apparatus according to claim 1, wherein the first facing surface is a surface orthogonal to a thickness direction of the first sheet metal, and wherein the second facing surface is a surface orthogonal to a thickness direction of the second sheet metal.

11. The image forming apparatus according to claim 1, further comprising a third sheet metal facing the first sheet metal, wherein the second sheet metal is connected to the first sheet metal and the third sheet metal, and a conveyance path through which the recording material is conveyed is disposed between the first sheet metal and the third sheet metal.

12. An image forming apparatus for forming an image on a recording material, the image forming apparatus comprising:

a first sheet metal including a first facing surface and a first rear surface opposite to the first facing surface;

a second sheet metal that is fixed to the first sheet metal by a fixing portion and including a second facing surface facing the first facing surface and a second rear surface opposite to the second facing surface; and an electronic substrate disposed so that the electronic substrate at least partly overlaps the fixing portion when seen in an orthogonal direction that is orthogonal to the first facing surface, wherein the first sheet metal is deformed in a first direction from the first rear surface toward the first facing surface in such a manner that the fixing portion is formed, and the fixing portion includes a projection projecting from the second rear surface in the first direction, and wherein the electronic substrate is disposed at a position that is on an opposite side of the first rear surface from the projection and faces the first rear surface in the first direction.

13. The image forming apparatus according to claim 12, wherein the electronic substrate includes an electric conductive portion configured to allow a current to flow in the electric conductive portion, and a printed wiring board having a first side where the electric conductive portion is disposed, and a second side opposite to the first side, and wherein the first side faces the first rear surface.

14. The image forming apparatus according to claim 13, wherein, when seen in the orthogonal direction, the electric conductive portion is disposed so that the electronic substrate at least partly overlaps the fixing portion.

15. The image forming apparatus according to claim 14, wherein the electric conductive portion includes a pattern on the first side.

16. The image forming apparatus according to claim 14, wherein the electric conductive portion includes an electronic part on the first side.

17. The image forming apparatus according to claim 14, wherein the electric conductive portion includes a terminal of an electronic part on the second side, and the terminal penetrates through the printed wiring board from the second side to the first side.

18. The image forming apparatus according to claim 12, wherein the first sheet metal includes a receiving portion configured to receive the electronic substrate.

19. The image forming apparatus according to claim 12, wherein the fixing portion is a mechanical fastening portion, and the projection is formed by deforming the second sheet metal, and wherein the first sheet metal is deformed to form a recess in the first rear surface toward the first facing surface.

20. The image forming apparatus according to claim 12, wherein the projection is formed by deforming the first sheet metal.

21. The image forming apparatus according to claim 12, wherein, when seen in the orthogonal direction, the projection has a circular shape.

22. The image forming apparatus according to claim 12, wherein the first facing surface is a surface orthogonal to a thickness direction of the first sheet metal, and wherein the second facing surface is a surface orthogonal to a thickness direction of the second sheet metal.

23. The image forming apparatus according to claim 12, further comprising a third sheet metal facing the first sheet metal, wherein the second sheet metal is connected to the first sheet metal and the third sheet metal, and a conveyance path through which the recording material is conveyed is disposed between the first sheet metal and the third sheet metal.

* * * * *